US006929190B1

(12) United States Patent
Adrian

(10) Patent No.: US 6,929,190 B1
(45) Date of Patent: Aug. 16, 2005

(54) PORTABLE MULTI-PURPOSE HEATING UNIT

(75) Inventor: Trevor Adrian, Park City, UT (US)

(73) Assignee: TAPC, LLC, Park City, UT (US)

( * ) Notice: Subject to any disclaimer, the term of this patent is extended or adjusted under 35 U.S.C. 154(b) by 0 days.

(21) Appl. No.: 10/222,667

(22) Filed: Aug. 15, 2002

Related U.S. Application Data

(60) Provisional application No. 60/312,649, filed on Aug. 15, 2001.

(51) Int. Cl.[7] ..... F24F 7/00
(52) U.S. Cl. ..... 237/47; 237/52
(58) Field of Search ..... 237/2 A, 19, 16, 237/70; 431/156, 203, 107; 126/275 E, 275 R; 392/473, 308, 444

(56) References Cited

U.S. PATENT DOCUMENTS

| | | | | |
|---|---|---|---|---|
| 3,140,740 A | | 7/1964 | Lagreid et al. | |
| 3,431,565 A | * | 3/1969 | Nelson | 4/598 |
| 3,773,458 A | | 11/1973 | Spotts | |
| 3,791,368 A | * | 2/1974 | Hunt | 126/25 A |
| 3,815,572 A | | 6/1974 | Wolfe | |
| 4,138,985 A | * | 2/1979 | Marley | 126/6 |
| 4,372,198 A | | 2/1983 | Stover, Jr. et al. | 99/340 |
| 4,718,601 A | * | 1/1988 | Chike | 237/16 |
| 4,954,075 A | | 9/1990 | Francino | |
| 4,996,970 A | * | 3/1991 | Legare | 126/205 |
| 5,016,611 A | | 5/1991 | Lai | |
| 5,121,739 A | * | 6/1992 | Barker | 126/248 |
| 5,125,835 A | | 6/1992 | Young | |
| 5,267,852 A | | 12/1993 | Mizuno | |
| 5,441,037 A | | 8/1995 | Yen | |
| 5,465,651 A | * | 11/1995 | Erickson et al. | 99/330 |
| 5,878,928 A | * | 3/1999 | Seiber | 224/153 |
| 5,921,229 A | | 7/1999 | Blake | |
| 6,209,795 B1 | * | 4/2001 | Rose | 237/9 B |
| 6,302,094 B1 | * | 10/2001 | Wehrly et al. | 126/5 |
| 6,354,511 B1 | * | 3/2002 | Hardee | 237/19 |

* cited by examiner

*Primary Examiner*—Derek S. Boles
(74) *Attorney, Agent, or Firm*—Workman Nydegger

(57) ABSTRACT

A multi-purpose heating unit is sized and configured to be used with a variety of attachments or devices to perform various functions such as heating, cooking and providing light. In particular, the multi-purpose heating unit includes a heat source which can be used with a water heating attachment, an air heating attachment, a cooking attachment, and/or a light source attachment. Each of these attachments is configured to be selectively attachable to the heat source. Advantageously, because the same heat source is used in connection with these different devices, this decreases the size, weight and storage volume of these devices. This also allows the heating unit and some or all of the desired attachments or devices to be stored and transported in a relatively small container.

52 Claims, 21 Drawing Sheets

218
216
218
214

214
212

208

216
226
228
232
224
210
222
230
220

PORTABLE MULTI-PURPOSE HEATING UNIT

CROSS-REFERENCE TO RELATED APPLICATIONS

This application claims the benefit of U.S. Provisional Application No. 60/312,649, filed Aug. 15, 2001 and entitled "Portable Multi-purpose Heating Unit," which application is hereby incorporated by reference in its entirety.

BACKGROUND OF THE INVENTION

1. The Field of the Invention

The present invention generally relates to portable heating equipment and, in particular, to portable heating equipment that can be used for multiple functions or purposes such as cooking, heating and showering.

2. The Relevant Technology

When camping or conducting other outdoor activities such as backpacking, biking, horseback riding, hunting, rafting, mountain climbing and boating, it is often desirable to have a stove on which to cook and prepare foods, a heater to heat an enclosure, such as a tent, camper, trailer and the like, a shower in which to take a hot shower, and a light source to provide light. These accoutrements, however, are often unavailable in remote locations or difficult to obtain because separate items must be individually transported to the desired location.

Various types of light sources, cooking stoves, heating devices and portable showers are known and can be used while camping, but these devices are often heavy and bulky, which makes them difficult to carry and transport. Additionally, because these are typically individual or single-purpose devices, the user must carry a separate light source, a stove, an air heater and/or a portable shower. Thus, the user must transport numerous devices in order to be able to perform these various tasks. The user, however, will often choose to go without these amenities rather than take all of this equipment because of the difficulty in transporting these devices.

In order to reduce the number of items carried by the user, it is known to have a light source that allows for both lighting and cooking. These known devices, however, require a large amount of space and are generally quite heavy. Additionally, these dual-purpose light source and cooking devices are generally inadequate because the heat source is so small that cooking times are unnecessarily long and it is difficult to adjust the amount of light coming from the light source. Further, the maximum heat provided by these dual-purpose devices is often limited in comparison to conventional cooking stoves, which limits the usefulness of the device as a stove.

One known device for cooking and lighting includes a burner unit that is used as a stove and a completely different unit that is used as a light source. The burner unit and light source unit require special adapters and equipment to convert the light source to a stove or vice versa. Generally, these separate burner units and light source units are attached by a connector to a common fuel source. Thus, this known device allows the same fuel source to be used to provide cooking and lighting functions. However, the only common elements that are used by both the light source and the stove are the fuel source and the connector to the fuel source. Disadvantageously, while this device allows the same fuel source and connection to the fuel source to be used, the user must still transport both the burner unit and the light source unit. Thus, this dual-purpose device still requires a large amount of space and is quite heavy, especially for use in outdoor activities in remote locations, such as camping, biking, climbing and hunting.

It is also known to use a water heater with a portable shower to allow the user to take a hot shower. Conventional portable showers, however, often do not provide adequate hot water. For example, in an attempt to keep such showers small and portable, relatively small heat sources have been used. Unfortunately, these small heat sources are usually not powerful enough to provide the desired supply of hot water. Gas powered devices, which provide a larger heat source, have traditionally not been used because of their size and bulk.

Additionally, conventional portable showers often use gravity to deliver the water to the individual taking a shower. The force of gravity, however, often does not provide adequate water pressure or sufficient force to deliver the water as a fine spray. In addition, gravity powered showers require the user to find a location above the head of the user to place a large reservoir of water, which typically contains about two gallons of water and weighs about twenty pounds. It is often difficult to find a sturdy location to place the reservoir of water, especially when camping in remote or desert locations, and it can be difficult and dangerous to lift the relatively heavy reservoir of water into the desired location. Conventional portable showers have also used pumps to increase water pressure, but these pumps often required a large power source that is heavy and awkward to carry over large distances.

Known portable showers often utilize a large container for holding the water. Typically, the water is heated within the container and a pump or gravity is used to supply the heated water from the container to the user. A significant drawback of these known portable showers is that the amount of hot water is limited by the size of the container. Thus, if more than one person wants to take a shower, they must refill the container with cold water and that water must then be heated. This often takes a significant amount of time, especially if a small heat source is being used. Additionally, these conventional portable showers require all the water in the container to be heated at one time and this requires a substantial amount of heat from the heat source and a large amount of time to heat all the water in the container. Thus, depending upon the size of the heat source and container, it can take up to thirty minutes or more to heat the water in the container for a hot shower. Disadvantageously, the heated water in the container, which is generally poorly insulated or not insulated at all, is constantly losing heat, which increases the time required to heat the water for a hot shower.

Conventional portable showers are often not truly portable because they are heavy, awkward to carry, and include a plurality of parts that must be carefully assembled. In addition, conventional portable showers often require the user to assemble and erect a number of components before the shower can be used. Furthermore, many of these known portable showers are expensive and require complex machinery to heat the water.

It is also known to use solar power for portable showers, but solar heated water is dependent on direct sunlight for heat. Thus, if direct sunlight is not available or if it is a cloudy day, a hot shower is not available. Further, solar heated systems require sunlight for a large portion of the day in order to sufficiently heat the water. Disadvantageously, this often requires the user to stay in one location for an extended period of time while the water is being heated. Another drawback of a solar heated system is that the water container is not insulated which allows a large amount of heat loss. Thus, solar heated systems do not work efficiently in low ambient temperature environments.

BRIEF SUMMARY OF THE INVENTION

A need therefore exists for a multi-purpose heating unit that can be used to perform multiple functions and eliminates the above-described problems.

One aspect of the present invention is a multi-purpose heating unit that can be used for multiple purposes or functions. In particular, the multi-purpose heating unit can be used for purposes such as, but not limited to cooking, heating air, heating water and/or providing a light source. Advantageously, because the multi-purpose heating unit can be used for multiple purposes, multiple different complete devices that perform these different purposes do not have to be transported or carried by the user. This allows the multi-purpose heating unit to be used by a wide variety of people such as campers, outfitters, backpackers, horseback riders, hunters, rafters, mountain climbers and the like. The multi-purpose heating unit which can meet varying needs may also be used in many different locations such as in parks, cabins, recreational vehicles (RV's), boats, beaches, etc. Thus, the multi-purpose heating unit can be used virtually anywhere, such as in the outdoors, in cabins without electrical power or water heaters, or wherever a heat source is desired.

Another aspect of the present invention is the multi-purpose heating unit comprises a heat source which provides a common base for a plurality of attachments. In particular, the multi-purpose heating unit includes a cooking attachment, an air heating attachment, a water heating attachment, and a lighting attachment. The heat source includes a fuel source and a fuel burner assembly. The fuel source is selectively attached to the fuel burner assembly to allow the fuel source to be rapidly changed or replaced. The fuel burner assembly is, in turn, selectively coupled to a plurality of different attachments so that different functions can be quickly and easily performed. Advantageously, this allows the same fuel source and fuel burner assembly to be selectively attached to different devices to provide different functions. Significantly, the common heat source decreases the weight, cost and storage volume because individual devices that perform these functions are no longer required.

The fuel source preferably comprises a high-efficiency heat source such as a propane powered burner. A propane powered burner can provide up to 10,000 BTUs, or more, to quickly and efficiently heat water or air, as desired. Additionally, the multi-purpose heating unit can effectively be used for cooking because the fuel source has a large heat output, can rapidly heat food or water, and can reach and maintain a high temperature. Significantly, because the amount of heat can be readily adjusted, the multi-purpose heating unit can be used as a cooking source.

The fuel burner assembly is configured such that it can be selectively coupled to a variety of attachments to perform different functions. These different functions include, but are not limited to heating air, heating water, cooking and/or providing a light source, which increase the potential uses of the multi-purpose heating unit. Preferably, these attachments are quickly interchangeable so that these different functions can be readily performed.

Preferably, the fuel burner assembly includes a heating element with a shield disposed thereon. The heating element includes a burner, a fuel conduit depending therefrom, and a connector which assists in selectively coupling the fuel burner assembly to the fuel source. A shield is disposed on the fuel conduit of the heating element. The shield comprises a pair of outwardly extending arms that create a secure friction or interference fit with the attachments. For example, the arms may be configured to be inserted into notches or receiving portions formed on the bottom portion of one of the various attachments to securely and selectively couple the fuel burner assembly to the various attachments. Alternatively, the arms may include one or more notches or receiving portions formed thereon to allow the fuel burner assembly to be securely and selectively attached to the various attachments.

Still another aspect of the multi-purpose heating unit is the same power source may be used in connection with these different devices. Thus, if the multi-purpose heating unit is used in connection with a water heater and/or an air heater, for example, the same power source may power the pump for the water heater and the fan for the air heater. The power source preferably includes a battery pack with rechargeable or replaceable batteries. Alternatively, electrical power can be supplied by any suitable external power source such as a car or recreational vehicle volt battery. Electrical power may also be supplied to the pump by a cigarette adaptor in a car or boat. Alternatively, power from the cigarette adaptor may be used to recharge the batteries of the power source.

Advantageously, the multi-purpose heating unit is lightweight and allows for easy conversion between use as a water heater, air heater, cooking surface, light source, and other desired tasks. Significantly, the multi-purpose heating unit provides quick and easy connection to the water heater, air heater, cooking surface, and light source. Further, the multi-purpose heating unit is easy to assemble and disassemble, which aids in its portability and ease of use.

One aspect of the present invention is a water heating attachment that is selectively couplable to the heat source. The water heating attachment allows the pleasure of hot showers to be taken at almost anytime and in almost any location. The water heating attachment can be used by a wide variety of people such as campers, outfitters, backpackers, horseback riders, hunters, rafters, bikers, mountain climbers and the like. The water heating attachment can also be used in many different locations such as in parks, cabins, recreational vehicles (RV's), boats, beaches, etc. Thus, the water heating attachment can be used to provide hot showers virtually anywhere in the outdoors, in cabins without electrical power or water heaters, or wherever a hot shower is desired.

Another aspect of the water heating attachment is it provides heated water very quickly and efficiently. For example, the water heating attachment does not have to heat an entire reservoir or container of water before supplying hot water. In contrast, the water heating attachment heats the water as it flows to the user without being stored or held in a container or reservoir either while the water is heated or thereafter. Thus, the water has minimal heat loss between the time the water is heated and its use by the user.

In greater detail, the water heating attachment includes a water transfer assembly and a heating assembly. The water transfer assembly delivers liquids or fluids, such as water, to the heating assembly. The water transfer assembly includes a pump disposed in communication with an intake to draw water into the heating assembly via an inlet. The heating assembly includes a heating core wherein the water passes through the heating assembly and heats the water as it flows through the heating core. The heating core may include an upwardly spiraled or horizontally coiled tube that allows heat from the heat source to rapidly and efficiently heat the water flowing through the tubing. The heated water exits the heating assembly through an outlet and enters an outlet tube or conduit that directs the water to the showerhead or other suitable type of fixture.

The coiled tubing of the heating core is preferably arranged to maximize the surface area of the tubing that is exposed to the heat source. Maximizing this surface area allows a maximum amount of heat to be transferred to the water in a minimum amount of time and space. Further, the coiled tubing is preferably constructed from a material, such as copper, that facilitates the transfer of heat from the heat source to the water.

The water heating attachment can provide a hot shower to a user in any location or setting, and it can be used in conjunction with a wide variety of water sources such as lakes, ponds, streams or rivers, culinary water supplies such as at houses, cabins or boats, or other external water sources. Significantly, the water heating attachment can be used any time that hot water is desired, such as for showering, cooking and cleaning. Further, the water heating attachment can be used in connection with other types of fluids or liquids that are desired to be heated quickly and efficiently.

Another aspect of the water heating attachment is it allows any suitable quantity of water to be quickly and efficiently heated. For example, the water heating attachment may provide enough hot water for a single shower or for a number of showers taken in rapid succession one after another. Advantageously, because the water heating attachment does not heat a reservoir or large container of water, the water heater does not waste energy by heating water that is not used immediately. Additionally, the water heating attachment is more efficient than conventional water heaters because it does not store or hold heated water in a reservoir until it is used. In contrast, the water heating attachment heats the water as it flows to the user. Thus, minimal amounts of heat are lost before the hot water is used, and only a minimal amount of heated water is not used immediately after being heated. Therefore, the water heating attachment is very efficient because it only heats the amount of water needed by the user at any given time, and the hot water is used immediately after it is heated.

Yet another aspect of the water heating attachment is it provides hot water within seconds of demand by the user. In particular, during operation the water heating attachment draws water from the water source and heats it in the heating assembly. The water is then immediately used by the user. Thus, because the water is heated in the heating assembly as it flows to the user, the user does not have to wait for a reservoir or container of water to be heated.

Yet another aspect of the water heating attachment is it can be used in conjunction with other suitable devices such as a privacy enclosure. The privacy enclosure allows a person to use the water heating attachment as a shower within a closed environment. The water heating attachment can also be used with a collapsible or adjustable pole to create a hand washer or it can supply water to a sink for cooking or cleaning.

In accordance with another aspect of the present invention, an air heating attachment is selectively attachable to the heat source. The air heating attachment is particularly useful in remote areas where access to more conventional methods for providing heat are unavailable, though the heating system may also be utilized in a variety of other locations as well. Advantageously, the air heated by the heating system is isolated from combustion-produced exhaust gases, allowing the air within an enclosed space, such as a tent, to be heated safely.

One aspect of the air heating attachment is an air transfer assembly that both draws air into the system and expels air out of the system. The air transfer assembly comprises an air intake conduit and an air outlet conduit, both of which have one end connected to a heating assembly. A motorized fan disposed within the air intake conduit draws air into the air intake conduit through the free end, and directs air through a heating core in the heating assembly and out the air outlet conduit. The motorized fan is powered by an electrical source, such as a battery. Advantageously, the air transfer system allows the user to draw air from either inside or outside of the location desired to be heated. For example, the air transfer assembly may be used to bring fresh outside air into a tent, or it may be used to recirculate and/or reheat the air already inside the tent. The air transfer assembly is also used to direct the heated air into the tent or other structure.

The heating assembly includes one or more exterior walls defining the perimeter of a housing, and the heating core disposed therein. The heating core may include a plurality of conduits or heat transfer tubes extending from one side of the housing to the other side of the housing. The heat transfer tubes, which transport the air to be heated through the heating assembly, advantageously isolate the air to be heated from the harmful exhaust gases produced by burning fuel during operation of the air heating system. Additionally, the heat transfer tubes may be constructed of copper, and are arranged in a pattern that maximizes their exposure to heat produced by a burner during operation of the device. Thus, the heat transfer tubes are configured to absorb the heat produced by the burner and transfer it to the air flowing through the heat transfer tubes. The heating assembly preferably includes one or more heat deflectors that assist in directing the heat produced by the burner toward the heat transfer tubes. The heat deflectors also increase the safety of the system by reflecting the heat away from the exterior walls of the heating assembly so that the walls are not the primary point of heat contact.

An important aspect of the air heating attachment is that the air flowing through the air transfer assembly does not mix with the exhaust gases and is isolated therefrom. That is, the heated air at no point comes into contact with the potentially dangerous gases, such as carbon monoxide, produced as a byproduct of the fuel combustion. These exhaust gases, which are produced in the heating assembly located exterior to the tent, pass harmlessly out of the heating assembly and into the atmosphere during operation of the system. Thus, the tent or other structure is safely isolated from the harmful exhaust gases, thereby safely heating the interior of the structure to provide a comfortable environment for persons therein.

The portable heating system may also be employed as a body warmer by directing the flow of heated air exiting the air outlet conduit over one's body. In yet another aspect, a portion of the heating assembly may be used as a heating surface that can be used, for example to warm food or even to warm or dry clothing.

In addition to safely heating enclosed areas or one's person, the air heating attachment is also compact and portable, thereby allowing it to be easily transported to remote areas. Due to its simple design, the air heating system is also easily set up for use in a minimum amount of time.

In yet another aspect of the present invention, the multipurpose heating unit may include a cooking attachment which is selectively attachable to the heat source. The cooking attachment comprises a cooking surface and an attachment portion. The attachment portion is configured to selectively couple to the heat source. In one embodiment, the attachment portion comprises a pair of arms that have notches formed thereon to selectively couple with the fuel burner assembly. In another embodiment, the shield of the fuel burner assembly comprises notches formed therein to selectively couple with the attachment portion.

The cooking surface of the cooking attachment may have a variety of configurations depending on the intended use of the cooking attachment. In one embodiment, the cooking surface may be a generally planar surface useful for frying or grilling. In another embodiment, the generally planar surface may have apertures formed thereon on which to place a cooking container. In yet another embodiment, the cooking attachment may comprise a rack having apertures formed thereon useful for a grilling surface. In still another embodiment, the cooking surface may comprise a bowl structure for heating liquids.

In still another aspect of the present invention, the multi-purpose heating unit may include a light source attachment. In one embodiment, the light source attachment is selectively interchangeable with the fuel burner assembly. That is, the light source attachment is configured to be selectively coupled to the heat source. In this embodiment, the light source attachment comprises a heating element having a shield disposed therein. The shield comprises a lower portion configured to be coupled to the heat source, an intermediate portion which includes a transparent wall for allowing light to pass through, and an upper portion.

In another embodiment, the light source attachment may comprise a shield having a transparent wall which is selectively interchangeable with the shield of the fuel burner assembly. Thus, the same fuel burner assembly that is used for the water heating, air heating, and cooking attachments may be utilized as a light source.

The multi-purpose heating unit is advantageously simple to assemble and disassemble. The multi-purpose heating unit is also portable and lightweight because it has relatively few components and many of the components are constructed from lightweight materials such as plastic. The multi-purpose heating unit is relatively easy to manufacture and assemble because it has relatively few parts, which significantly reduces manufacturing costs. The multi-purpose heating unit is also rugged because it is constructed from durable materials and components that can withstand extended use in a wide variety of environments. Further, in contrast to conventional heating units, the present multi-purpose heating unit is truly portable and lightweight, allowing it to be readily used in a wide variety of situations and locations.

A further aspect of the multi-purpose heating unit is that it can be used with a container or carrying case so that it can be easily transported and assembled. Desirably, the container allows the various components of the heating unit to be stored therein when not in use. The container may also store various suitable attachments such as the portable shower, air heater, light source and/or stove together in one place. The container includes a recessed handle and a removable lid with a recessed portion that can support all or a portion of the heating unit in a desired position. In particular, the recessed portion is configured to receive a fuel source, such as a pressurized propane gas cylinder, for the heating unit. Desirably, the recessed portion holds the fuel source and the heating unit securely during use to prevent accidental tipping over of the heating unit. Thus, the lid of the container can be used to provide a sturdy and stable base for the multi-purpose heating unit. The lid may also be used to support the various attachments in an upright position.

These and other aspects, features and advantages of the present invention will become more fully apparent from the following description of the preferred embodiments and appended claims.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention involves a portable multi-purpose heating unit that can be used for heating, cooking and/or providing light. Advantageously, the multi-purpose heating unit can be used with a number of different devices or attachments for various purposes. The principles of the present invention, however, are not limited to multi-purpose heating units. It will be understood that, in light of the present disclosure, the heating units can be successfully used in connection with other types of devices and equipment.

Additionally, to assist in the description of the multi-purpose heating unit, words such as top, bottom, front, rear, right and left are used to describe the accompanying figures. It will be appreciated, however, that the multi-purpose heating unit can be located in a variety of desired positions-including upside down. A detailed description of the multi-purpose heating unit now follows.

Figure 1:
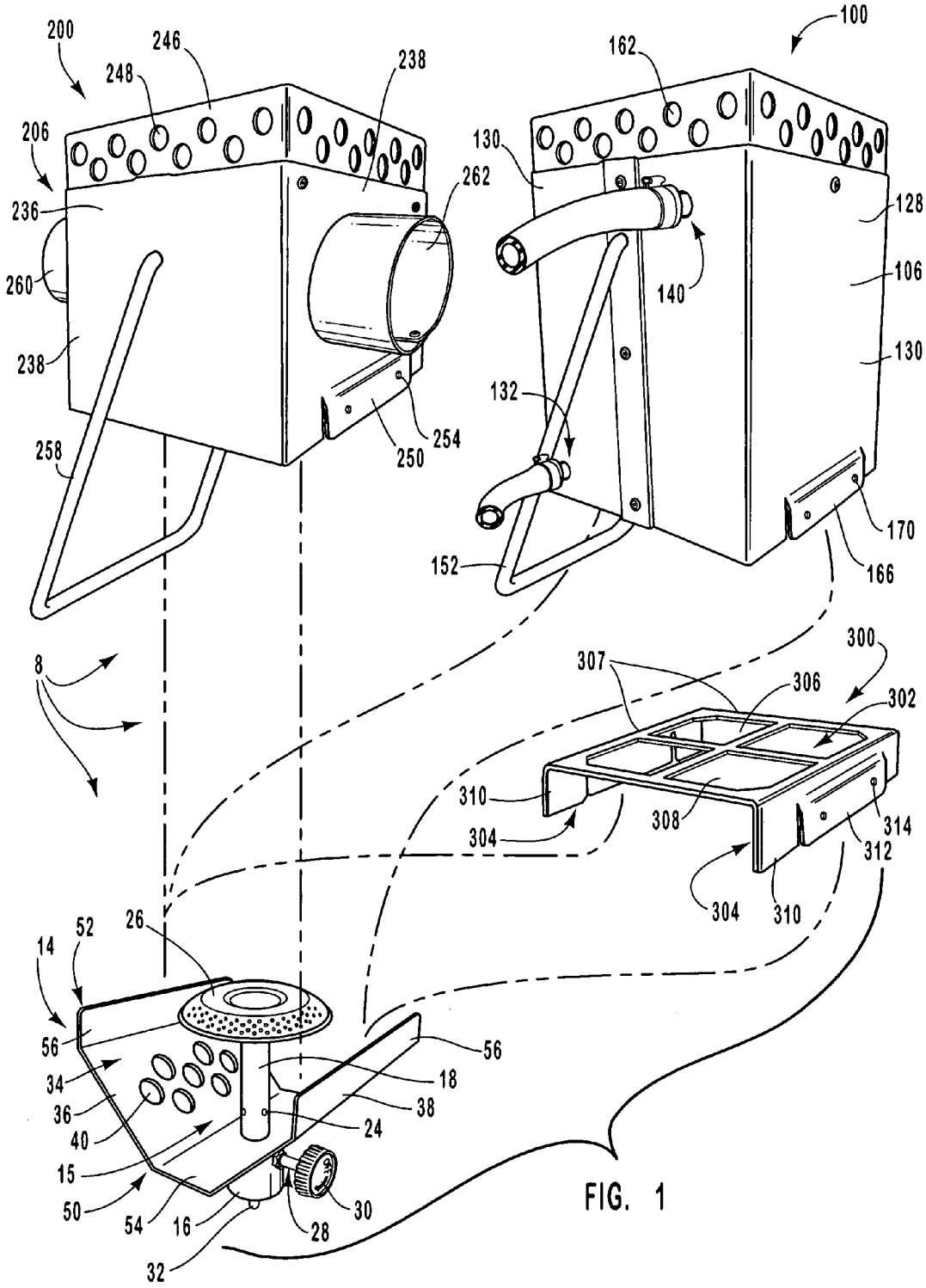
FIG. 1 is an exploded perspective view of a portion of one embodiment of a portable multi-purpose heating unit in illustrating a fuel burner assembly that can be used in connection with an air heating attachment, a water heating attachment and/or a cooking attachment.

Some of the features of one embodiment of a multi-purpose heating unit (denoted generally by reference numeral 8) are shown in FIG. 1 and throughout the accompanying figures. Multi-purpose heating unit 8 may desirably be used to perform a variety of different purposes or functions. For example, as discussed below, multi-purpose heating unit 8 may be readily converted into an air heater, a water heater, a cooking surface, and/or a light source. In one embodiment, multi-purpose heating unit provides a common base structure upon which a plurality of attachments may be selectively interchangeable. As used herein, the term "plurality" indicates two or more attachments. It will be appreciated that a common base decreases the size, weight and storage volume of the multi-purpose heating unit 8 because the same common base is used for these different functions and purposes. Utilizing a common base allows multi-purpose heating unit 8, including some or all of the desired attachments, to be stored and transported in a relatively small container. Accordingly, multi-purpose heating unit 8 is "portable."

Figure 2:
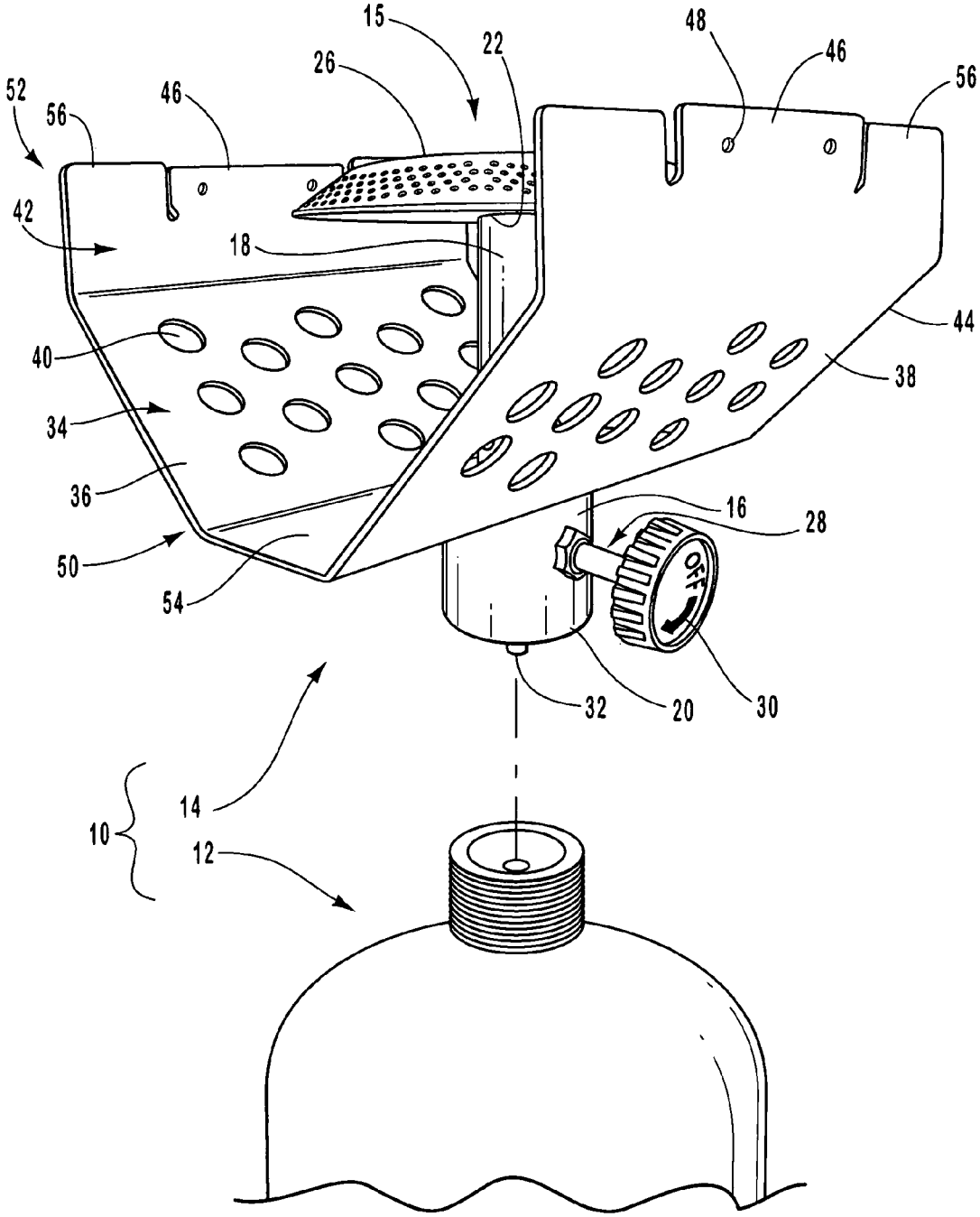
FIG. 2 is a perspective view of one embodiment of the fuel burner assembly of FIG. 1.

As shown in FIG. 2, multi-purpose heating unit 8 comprises a heat source 10. In one embodiment, heat source 10 comprises a fuel source 12 and a fuel burner assembly 14. As depicted in FIG. 1, fuel burner assembly 14 may be selectively coupled to a plurality of different attachments. Each attachment is configured to enable the user to perform different tasks such as, but not limited to, heating water, heating air, cooking, and/or providing light. Such attachments are described below and are shown in FIG. 1. More specifically, FIG. 1 illustrates one embodiment of a water heating attachment 100, an air heating attachment 200, and a cooking attachment 300. In addition, a light source attachment 400 (not shown) may be provided.

Returning to FIG. 2, fuel source 12 is a container or tank of combustible gas, such as propane, but other suitable types of fuel may also be used. In one embodiment, the container for fuel source 12 is a pressurized cylinder of gas. It will be appreciated that various sizes of containers for fuel source 12 may be utilized, depending upon the intended use of multi-purpose heating unit 8. It is contemplated that the various sizes and configurations of fuel sources that are readily available may be utilized. By way of example and not limitation, the container of fuel source 12 may include up to five gallons, or more, of gas for extended use of multi-purpose heating unit 8 in a remote cabin or at a large campsite with numerous people. Similarly, it is contemplated that the container for fuel source 12 may be of the style often used for campers, barbeques and the like. Alternatively, the container for fuel source 12 may include only a few ounces of gas for use by backpackers, hikers and mountain climbers, and the like.

As illustrated in FIGS. 1 and 2, in one embodiment heat source 10 includes a fuel burner assembly 14 which combusts fuel to create heat. Fuel burner assembly 14 comprises a heating element 15 having a shield 34 disposed thereon. Heating element 15 comprises a burner 26, a fuel conduit 18, and a connector 16 that contains control valve 28. In one embodiment, connector 16 selectively couples heating element 15 to fuel source 12 by threads that allow heating element 15 to be releasably connected to fuel source 12. It will be appreciated that various other methods of releasably connecting fuel burner assembly 14 to fuel source 12 may be utilized. Connector 16 includes a control valve 28 that controls the flow of fuel from fuel source 12 to heating element 15. Control valve 28 has a control knob 30 attached thereto and is disposed in connector 16 to selectively control the flow of fuel through connector 16. A needle 32 extends from connector 16 into the outlet of fuel source 12 to enable fuel from the fuel source 12 to flow into connector 16.

Figure 15:
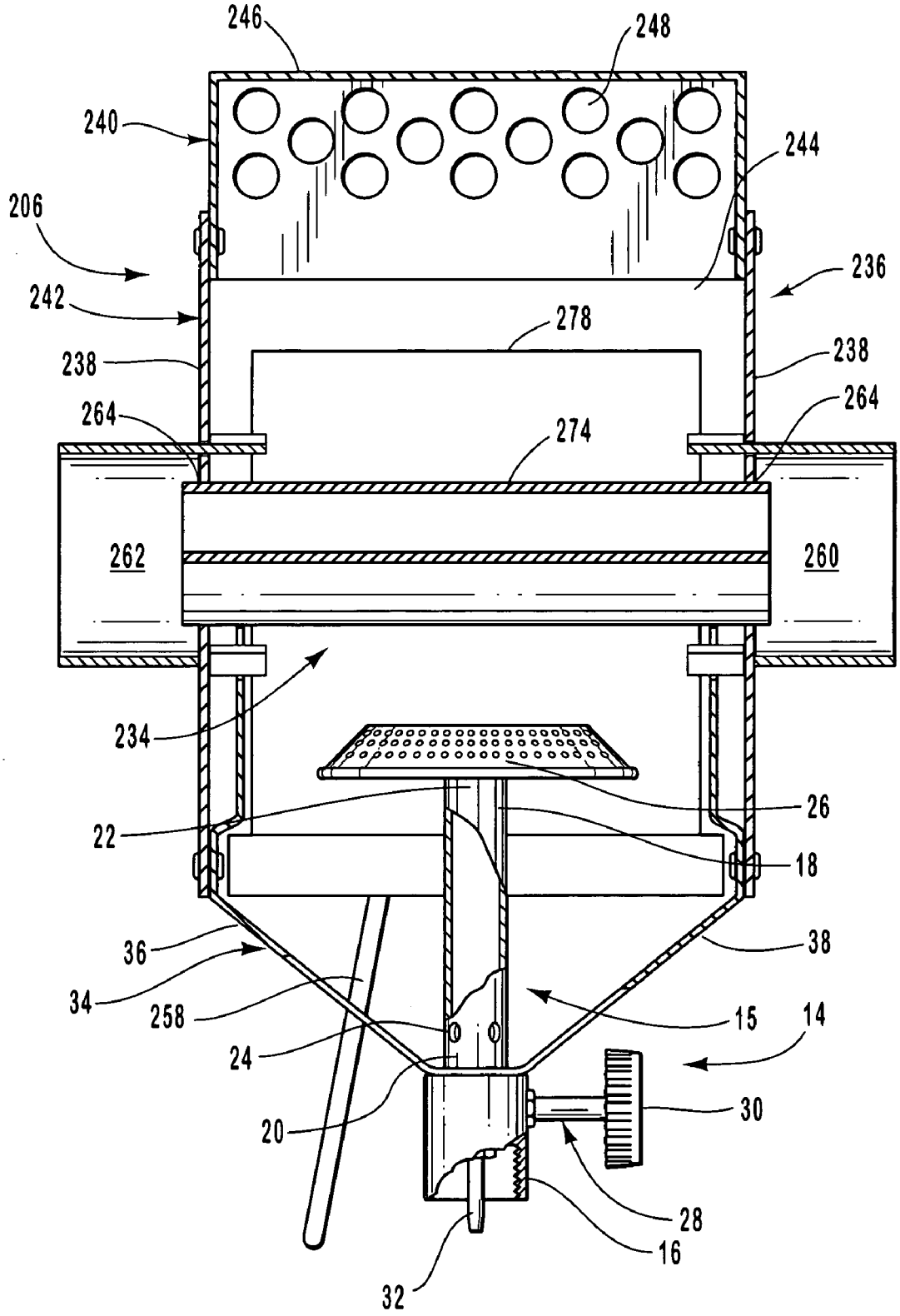
FIG. 15 is a cross sectional front view of one embodiment of a heating assembly of the air heating attachment of FIG. 13.

Connector 16 connects fuel source 12 to a fuel conduit 18. As depicted in FIG. 15, fuel conduit 18 has a first end 20 and a second end 22. Fuel conduit 18 also includes openings 24 that are spaced about fuel conduit 18 to allow air to be mixed with the fuel to promote efficient burning of the fuel. In one embodiment, fuel conduit 18 has four openings 24 formed therein. It will be appreciated by one skilled in the art that various other numbers of openings 24 could be utilized to carry out the function thereof. Further, in one embodiment, openings 24 are equally spaced about the circumference of fuel conduit 18. It will also be appreciated that various other configurations and spacings of openings 24 may be utilized to carry out the intended function thereof. Openings 24 are intended to allow a quantity of air to mix with the fuel to achieve efficient burning of the fuel. Accordingly, openings 24 are sized and configured to create the proper air-fuel mixture for efficient combustion of the fuel.

One embodiment of burner 26 is depicted in FIG. 15. Burner 26 is attached to second end 22 of fuel conduit 18 and includes a plurality of openings to release the fuel-air mixture.

Returning to FIG. 2, shield 34 is disposed on fuel conduit 18 of heating element 15. In one embodiment, shield 34 includes two opposing, upwardly extending sidewalls 36, 38 joined by a substantially planar segment 54. Planar segment 54 may rest on connector 16 or be welded or otherwise attached thereto. It will be appreciated that various other fastening or attaching methods may be used to attach shield 34 to connector 16. Sidewalls 36 and 38 have a first end 50 adjoining to substantially planar segment 54, and a second end 52 configured to selectively couple to one or more attachments. Second end 52 of sidewalls 36 and 38 comprises a vertical portion 56 which is positioned to be selectively coupled to one or more attachments as shown in FIG. 1. It will be appreciated that shield 34 could have various other configurations as long as it is configured to cooperate with connector 16 and is adapted to selectively attach to various attachments.

In one embodiment depicted in FIG. 1, the upper portions of sidewalls 36 and 38 of shield 34 are separated by a distance. Generally, this distance corresponds to the length or width of the housings of at least some of the attachments such that fuel burner assembly 14 can be readily selectively attached to the attachments. In one embodiment, the attachments comprise one or more notches 250, 166 and 312 formed on a bottom portion of the housings of the attachments which are configured to fit over engaging portion 56 of sidewalls 36 and 38 of shield 34 to create a friction engagement of fuel burner assembly 14 to the attachment.

It will be appreciated that various other ways of attaching fuel burner assembly 14 to the attachments could be utilized. For example, in one embodiment shown in FIG. 2, engaging portion 56 of sidewalls 36 and 38 of shield 34 comprises notches 46 formed thereon for frictionally engaging a corresponding portion of one of the attachments as will be described in more detail later on. As such, corresponding notches would not be necessary on the housing of an attachment. Rather, the side of the attachment could simply be selectively received in notches 46 of shield 34. Any of notches 46 on shield 34 may include one or more inwardly extending bumps or protrusions 48 that engage the housing of the attachments. Advantageously, this friction and/or compression engagement of fuel burner assembly 14 to the attachments creates a secure, but releasable connection that allows multi-purpose heating unit 8 to be easily assembled and disassembled. It will be appreciated that both fuel burner assembly 14 and the attachment may comprise notches formed thereon such that the notches can be selectively coupled in an interlocking manner to form a secure engagement.

In addition, by way of example and not limitation, sidewalls 36 and 38 of shield 34 may be either slightly compressed or expanded to create a more secure connection of fuel burner assembly 14 to any of the various attachments. As illustrated in FIG. 1, any of the notches on the attachments or shield 34 may include one or more inwardly extending bumps or protrusions that engage sidewalls 36 and 38 of shield 34. Advantageously, this friction and/or compression engagement of fuel burner assembly 14 to the attachments creates a secure, but releasable connection that allows multi-purpose heating unit 8 to be easily assembled and disassembled. It will be appreciated that various other methods of selectively attaching the attachments to burner assembly 14 may be used such as, by way of example and not limitation, a sliding arrangement or a releasable snap fit arrangement. Alternatively, in another embodiment, fuel burner assembly 14 may be releasably connected to any one of the attachments by any suitable means well known in the art such as clips, screws, hinges, and the like. The details of selectively coupling an attachment of multi-purpose heating unit 8 to fuel burner assembly 14 of heat source 10 will be described in more detail later on with regard to the specific attachments.

In one embodiment of shield 34 depicted in FIG. 1, sidewalls 36 and 38 of shield 34 include a plurality of openings 40 to allow air to be introduced to burner 26 of heating element 15. It will be appreciated that while openings 40 are in one embodiment depicted as being round, openings 40 may have various other shapes such as being oval, elliptical, square, rectangular, octagonal or the like or combinations thereof. In one embodiment, shield 34 also includes open opposing ends 42, 44 to allow additional air to be introduced to burner 26 of heating element 15. Advantageously, shield 34 allows a large quantity of air to be introduced into heating element 15 while also protecting burner 26 from damage and generally preventing the user or other objects from touching burner 26 or contacting the burning gas.

As illustrated, in one embodiment, sidewalls 36 and 38 are extending angularly away from each other in an upward direction. It will be appreciated that sidewalls 36 and 38 of shield 34 could have different configurations, such as being flat, and perform the function thereof. It will be appreciated by one skilled in the art that shield 34 could have various other configurations and perform the function thereof. By way of example and not limitation, shield 34 could be an open box-like structure that is either formed of one sheet of material or multiple sheets attached together. Similarly, shield 34 could have the configuration of a half sphere with a flat spot at the center where shield 34 is connected to fuel conduit 18. Alternatively, shield 34 could be U-shaped. It will be appreciated that numerous other configurations of shield 34 may be utilized to perform the function thereof.

In one aspect of multi-purpose heating unit 8, fuel burner assembly 14 can include one or more heating elements 15 depending, for example, upon the amount of heat desired. For example, two heating elements 15 may be used with a water heating attachment to increase the temperature of the water. Additionally, two heating elements 15 may be used with an air heating attachment to rapidly increase the temperature within the tent or to allow the air heater to be used in extremely low temperatures.

Figure 3:
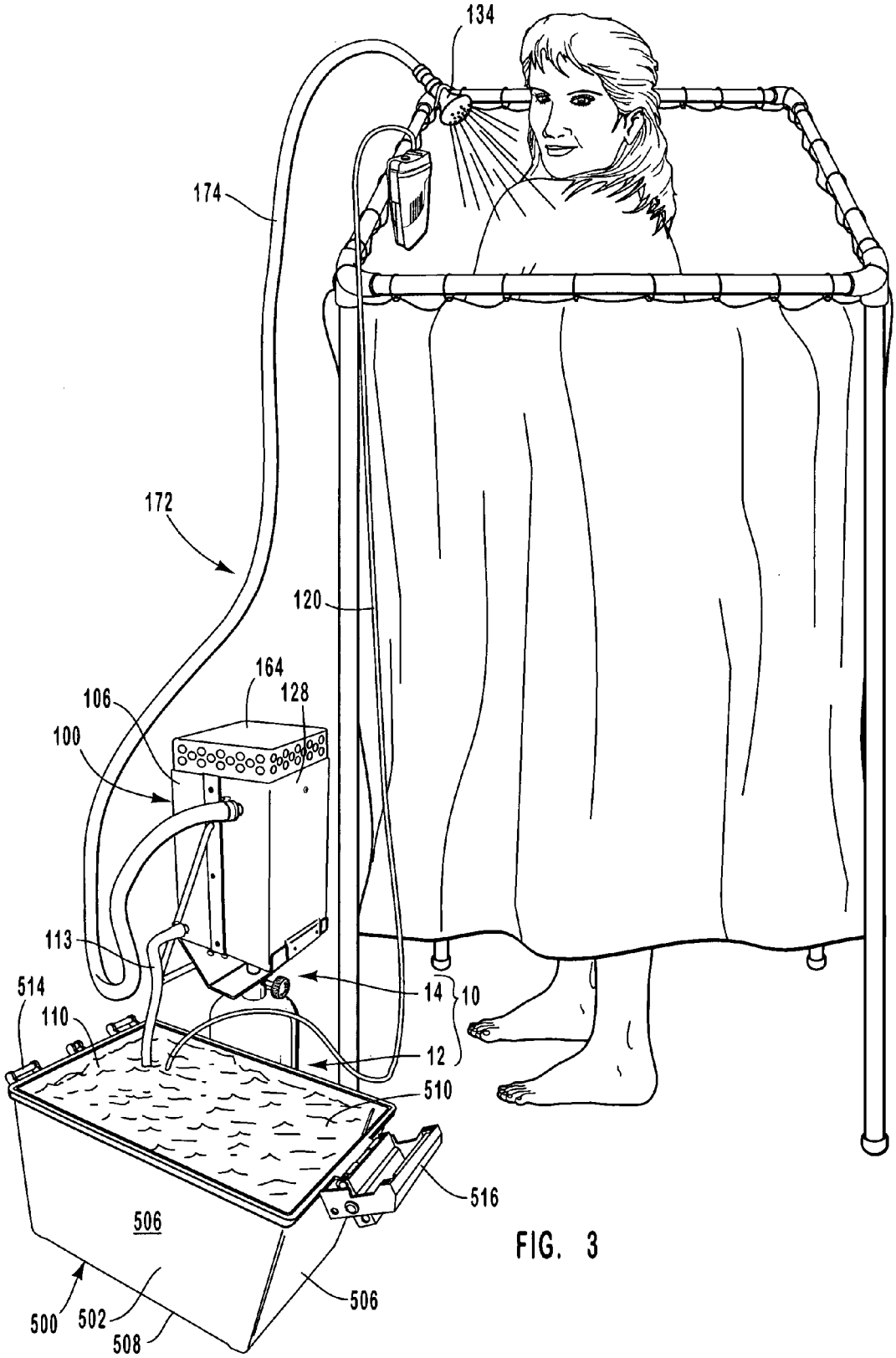
FIG. 3 illustrates a perspective view of one embodiment of the portable multi-purpose heating unit with one embodiment of a water heating attachment being used as a shower.

In accordance with one aspect of the present invention, the multi-purpose heating unit 8 comprises a water heating attachment 100. As seen in FIG. 3, water heating attachment 100 may be selectively coupled to heating source 10 to provide a hot shower to a user in a variety of locations. For example, water heating attachment 100 allows a user to take a hot shower while camping, hiking, climbing, backpacking, etc. The shower can be used in conjunction with a privacy enclosure 120, if so desired. Alternatively, water heating attachment 100 can be used any time hot water is desired, such as for cooking and cleaning.

Figure 4:
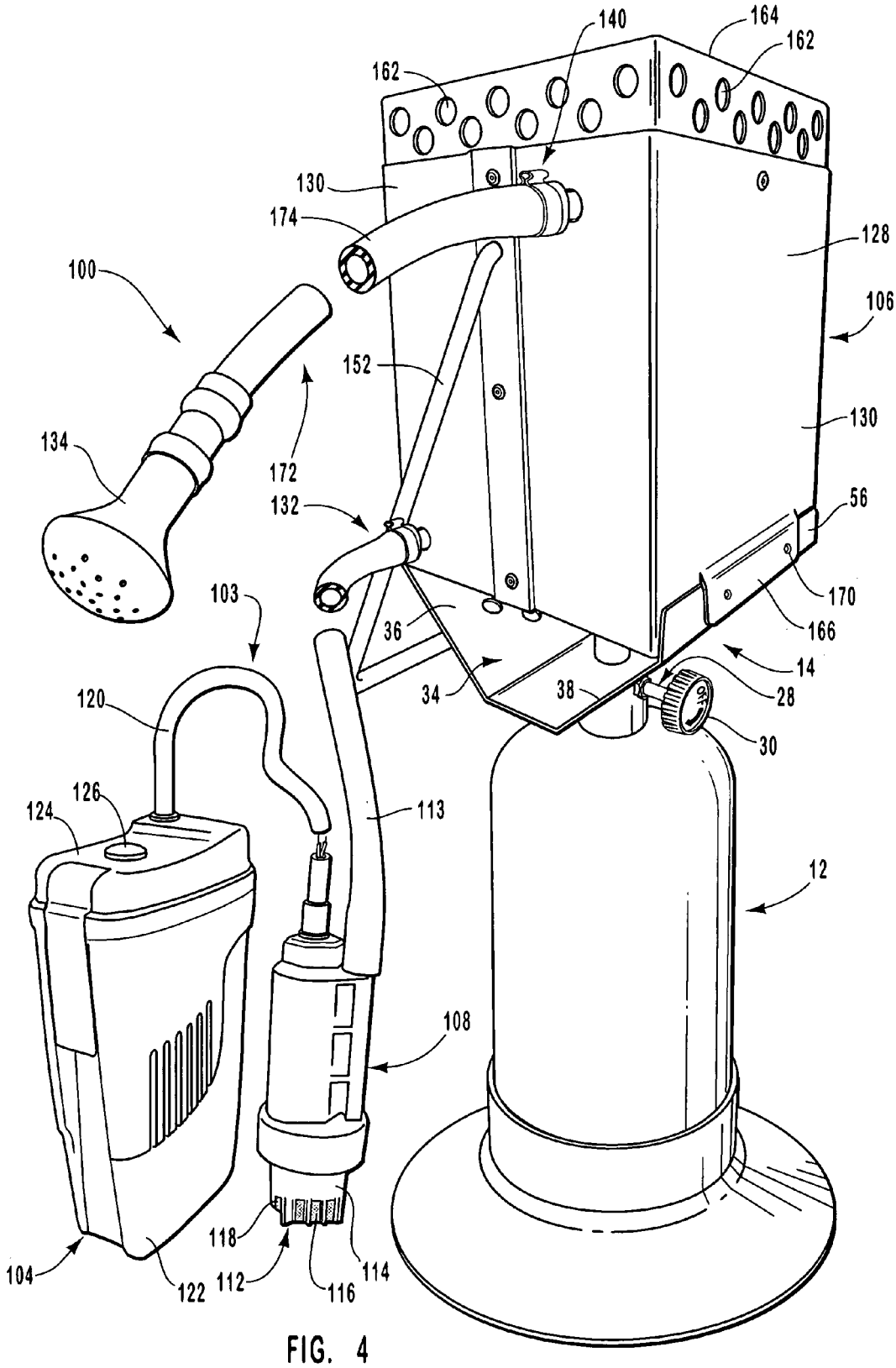
FIG. 4 is a partial breakaway perspective view of the water heating attachment shown in FIG. 3.

FIG. 4 depicts one embodiment of water heating attachment 100 which includes a water transfer assembly 103 and a heating assembly 106. Water transfer assembly 103 comprises a pump 108 and a power supply 104, as well as conduits disposed there between to connect water transfer assembly 103 to heating assembly 106.

Pump 108 is configured to be disposed in a water source 110 (FIG. 3). As seen in FIG. 4, pump 108 includes an intake 112 that allows water from water source 110 to enter the water heating attachment 100. Intake 112 desirably includes a removable cover 114 with a series of openings 116 to allow the water to enter pump 108. Intake 112 may also include a filter 118 that prevents foreign objects or other unwanted debris from entering the water heating attachment. Advantageously, in one embodiment, cover 114 is threadably connected to intake 112 of pump 108 such that cover 114 can be removed and cleaned, and this also allows intake 112 to be directly connected to a water source such as a hose. It will be appreciated that cover 114 could also be attached using a snap fit or various other methods of retaining cover 114 on pump 108 which are known in the art.

As illustrated in FIG. 3, during use pump 108 is disposed in water source, such as water source 110, to draw water into water heating attachment 100. Accordingly, in one embodiment, depicted in FIG. 4, pump 108 is encased in a durable material such as plastic to protect it from damage, and to allow pump 108 to be submerged in water. The design and configuration of intake 112 and pump 108 allow water heating attachment 100 to be used in a wide variety of locations and environments because intake 112 and pump 108 can simply be inserted into any suitable water source 1110, such as a lake, stream, pond or river. Advantageously, intake 112 and pump 108 can also be used in connection with other types of water sources 110, such as a culinary water supply, water container or reservoir.

Pump 108 is preferably sized and configured to supply a sufficient volume of water for bathing or showering. One skilled in the art will appreciate that the volume of water delivered by pump 108 is dependent upon factors such as the size and speed of pump 108. Thus, those skilled in the art will understand that the size and speed of pump 108, for example, may be varied depending upon the intended use of water heating attachment 100. That is, pump 108 may be differently sized or configured if water heating attachment 100 is intended to be used for showering or for cooking. Additionally, although in one embodiment pump 108 is depicted as being located near or formed in conjunction with intake 112, pump 108 could be located in any suitable location or portion of water heater attachment 100 and still perform the function thereof with intake 112 being a separate member located remote from pump 108.

Power supply 104 is electrically connected to pump 108 by an electrical line 120. As shown in FIG. 4, power supply 104 includes a container 122 with a lid 124 and an on/off switch 126 for selectively controlling the flow of power to pump 108. In one embodiment, lid 124 is movingly attached to container 122. It will be appreciated that lid 124 could be attached to container 122 by hinges or by a resilient member that allows lid 124 to be selectively attached to container 122. Further, lid 124 and/or container 122 of power supply 104 may include one or more inwardly extending bumps or protrusions that engage lid 124. In another embodiment, lid 124 could be selectively attached to container 122 by a sliding arrangement formed on both lid 124 and container 122 such that when lid 124 is slidingly mounted on container 122 it cooperates therewith to selectively lock in place. One skilled in the art will appreciate that various methods of moveably attaching or fasting lid 124 to container 122 may be utilized.

Power supply 104 may include batteries. In one embodiment, power supply 104 uses multiple "D" sized batteries that are inserted into container 122 to supply power to pump 108. More specifically, in one embodiment, power supply 104 includes four "D" sized batteries. It will be appreciated that depending on the size of power supply 104 and amount of water to be heated by water heating attachment 100, various other numbers, sizes, and/or types of batteries may be utilized. The batteries used in power supply 104 may be replaceable or rechargeable, or power supply 104 may comprise a sealed battery. It will be appreciated that power provided by power supply 104 may vary according to the size and power requirements of pump 108. For example, a larger power supply 104 may be required for a larger pump 108 while a smaller power supply may be used with a smaller pump. Additionally, power may also be supplied by any suitable power source such as a car, recreational vehicle or boat battery, a cigarette lighter in a car or boat, connection to an electrical outlet or power grid, gasoline powered or other type of auxiliary motor, or the like.

As depicted in FIG. 4, intake 112 and pump 108 are in fluid communication with an intake tube 113. In one embodiment, intake tube 113 is constructed from a resilient flexible material and allows the water to flow directly from pump 108 to heating assembly 106. Advantageously, pump 108 provides pressurized water for the user and, when water heating attachment 100 is being used in conjunction with a shower, the force of gravity is not required to cause the water to flow from water source 110 to a showerhead 134. In contrast, many conventional portable showers require the user to place a heavy reservoir of water above the individual using the shower and then use the force of gravity to cause the water to flow to showerhead 134.

As illustrated, in one embodiment, heating assembly 106 of water heating attachment 100 includes a housing 128. In this embodiment, housing 128 includes four sidewalls 130 and has a generally rectangular configuration. It will be appreciated that housing 128 could have various other numbers of sidewalls 130 and still perform the function thereof. In addition, it will be appreciated that housing 128 could have various other configurations. By way of example and not limitation, housing 128 could be square, cylindrical, oval, elliptical, and the like or combinations thereof. In one embodiment, housing 128 has a length and a width of about five inches and a height of about six inches, but it will be understood that housing 128 may have any desired size depending upon various factors such as the rate at which water is to be heated.

As illustrated in FIGS. 1 and 4, in one embodiment heating assembly 106 also includes an inlet 132 that is disposed on one sidewall 130 of housing 128 and it is connected to intake tube 113. Inlet 132 allows the water to flow into a heating core 136 (see FIG. 6) disposed inside housing 128.

Figure 6:
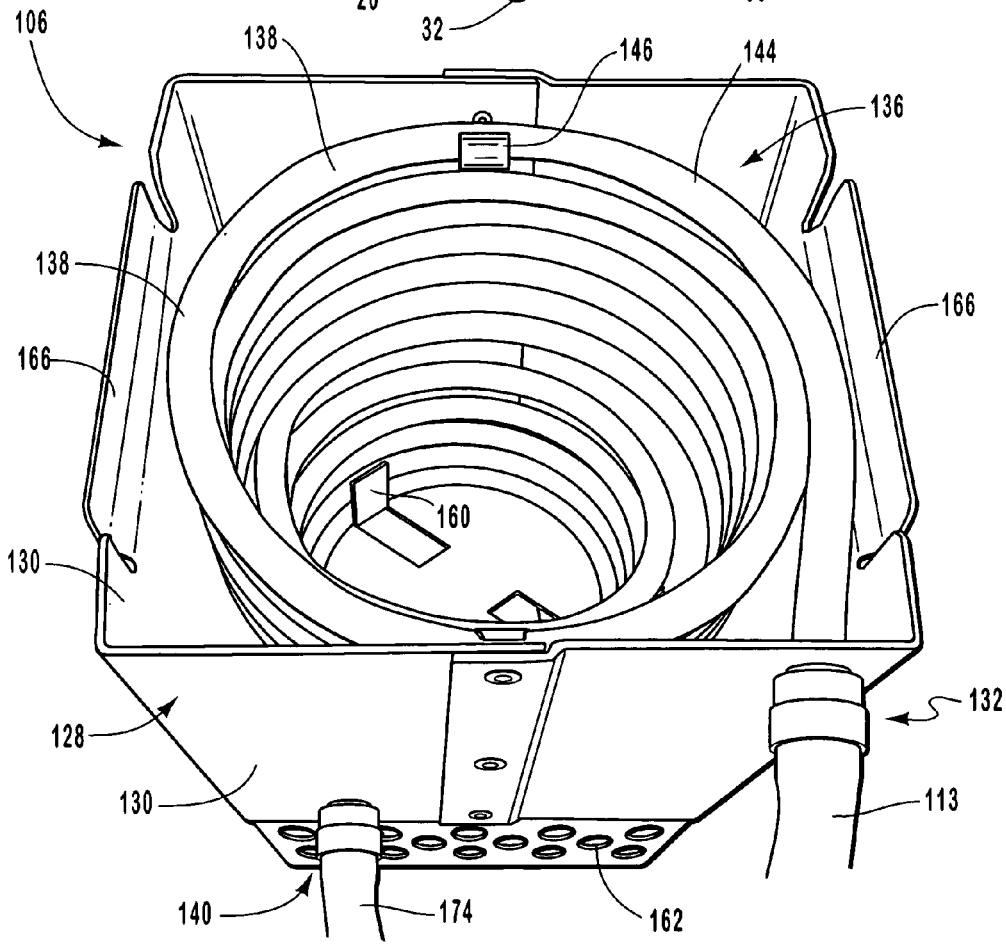
FIG. 6 is a perspective view from the bottom and looking toward the top of a portion of one embodiment of a water heating attachment shown in FIG. 3, illustrating one embodiment of a heating assembly.
Figure 7:
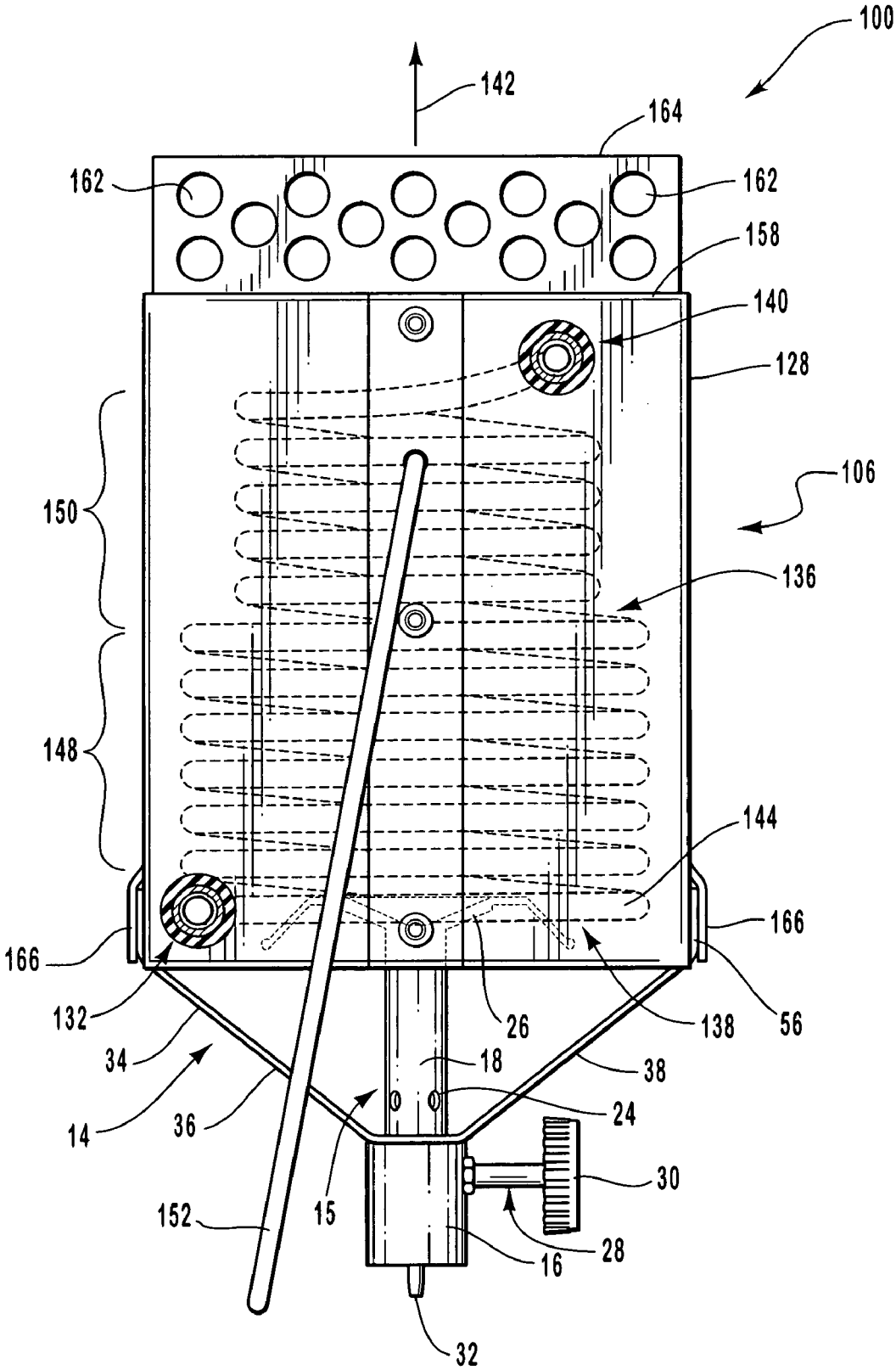
FIG. 7 is a side view of one embodiment of the portable multi-purpose heating unit with a portion of one embodiment of the water heating attachment of FIG. 3 attached.

As shown in FIGS. 6 and 7, in one embodiment heating core 136 includes an elongate coiled tube 138 that spirals upwardly within housing 128 towards an outlet 140 disposed on sidewall 130 of housing 128. It will be appreciated that inlet 132 and outlet 140 may be disposed on different sidewalls 130 of housing 128. As shown in FIG. 4, outlet 140 is disposed above inlet 132. However, it will be appreciated that inlet 132 and outlet 140 may be configured in various other orientations on housing 128.

In one embodiment shown in FIG. 6, coiled tube 138 includes a plurality of closely spaced coils having one or more different diameters D relative to the longitudinal axis of heating core 136. More specifically, in one embodiment illustrated in FIGS. 6 and 7, coiled tube 138 of heating core 136 is generally disposed about a generally centrally located vertical axis 142 (FIG. 7) within housing 128. A first coil 144 is located proximate the lower end of housing 128 and is attached to sidewall 130 of housing 128 by bracket 146 (FIG. 6). In one embodiment, two brackets 146 are used to attach first coil 144 to the lower end of housing 128. It will also be appreciated that various other numbers of brackets 146 may be used to carry out the function thereof. Brackets 146 hold first coil 144 of coiled tube 138 in a generally stationary position, but may allow some amount of movement, such as expanding movement, for example, while the water is heated as it flows through water heating attachment 100. It will be appreciated that various types of fastening or connecting methods could be used to generally keep first coil 144 coiled tube 138 in place with respect to housing 128.

Figure 8:
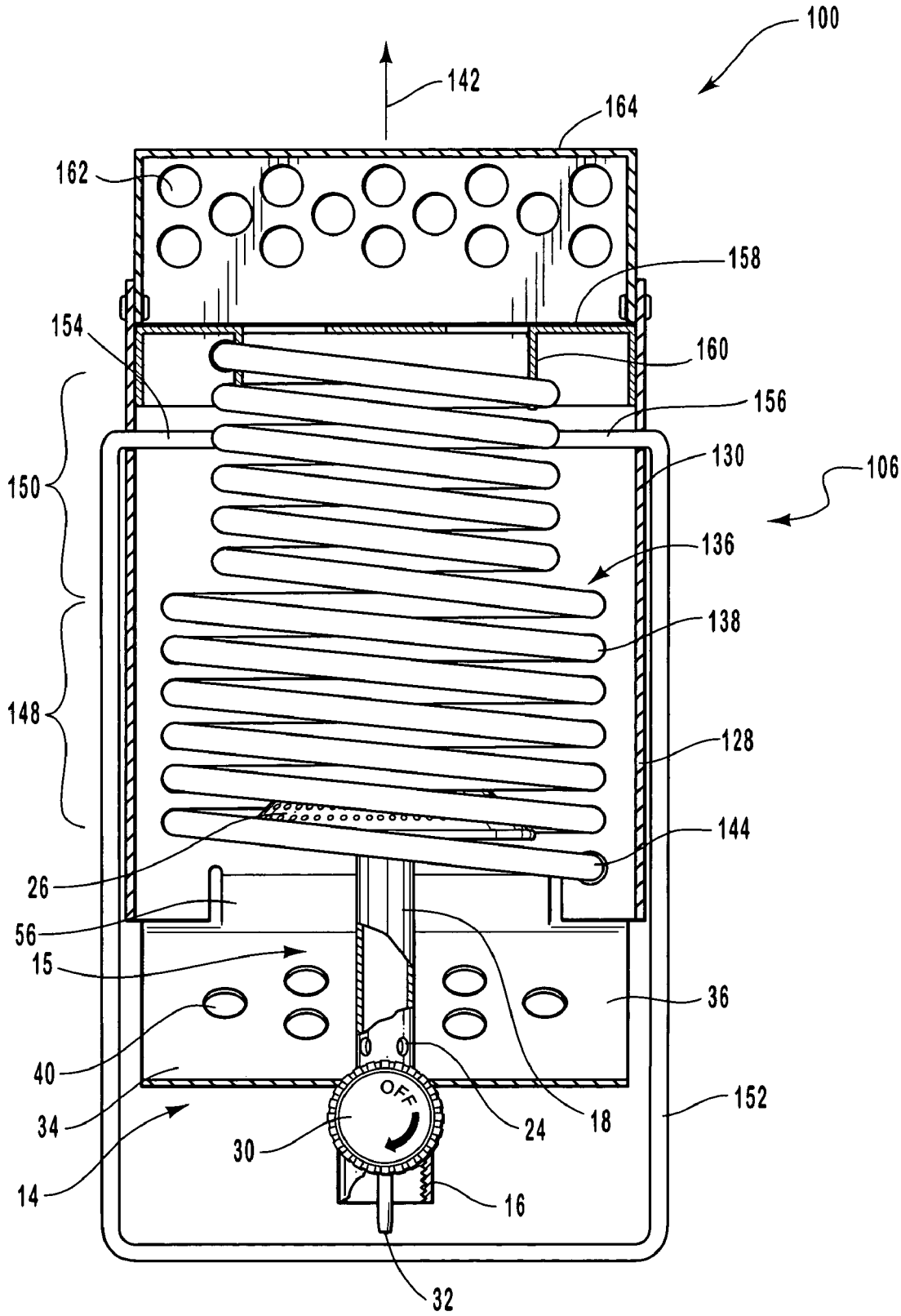
FIG. 8 is a partial cross sectional side view of the portion of the water heating attachment shown in FIG. 7.

In one embodiment, first coil 144 has an inside diameter such that the outer portion of coil 144 is disposed proximate, or actually touches, sidewalls 130 of housing 128. As depicted in FIGS. 7 and 8, in one embodiment, first coil 144 is part of a first series of coils 148 that spiral generally upwardly. This first set of coils 148 in one possible embodiment has an inside diameter X that is about four inches or smaller.

In one embodiment shown in FIGS. 7 and 8, coiled tube 138 of heating core 136 also includes a second set of coils 150 that have an inside diameter Y that is smaller than the inside diameter X of the first set of coils 148. In one embodiment, second set of coils 150 have an inside diameter Y of about three inches. One skilled in the art will appreciate that first set of coils 148 and second set of coils 150 may have any suitable diameter depending, for example, upon the size of housing 128, the rate at which water is to be heated or the diameter of the tubing. It will be appreciated that heating core 136 could have various other configurations and perform the function thereof. For example, first and second sets of coils 148, 150, respectively, of coiled tube 138 could be each in the shape of two cylindrical portions joined together. Alternatively, first and second sets of coils 148, 150 of coiled tube 138 may be configured to form a conical shape or two conical shapes that are joined together. In addition, by way of example and not limitation, first and second sets of coils 148, 150, respectively, of coiled tube 138 of heating core 136 could be reversed.

Figure 9:
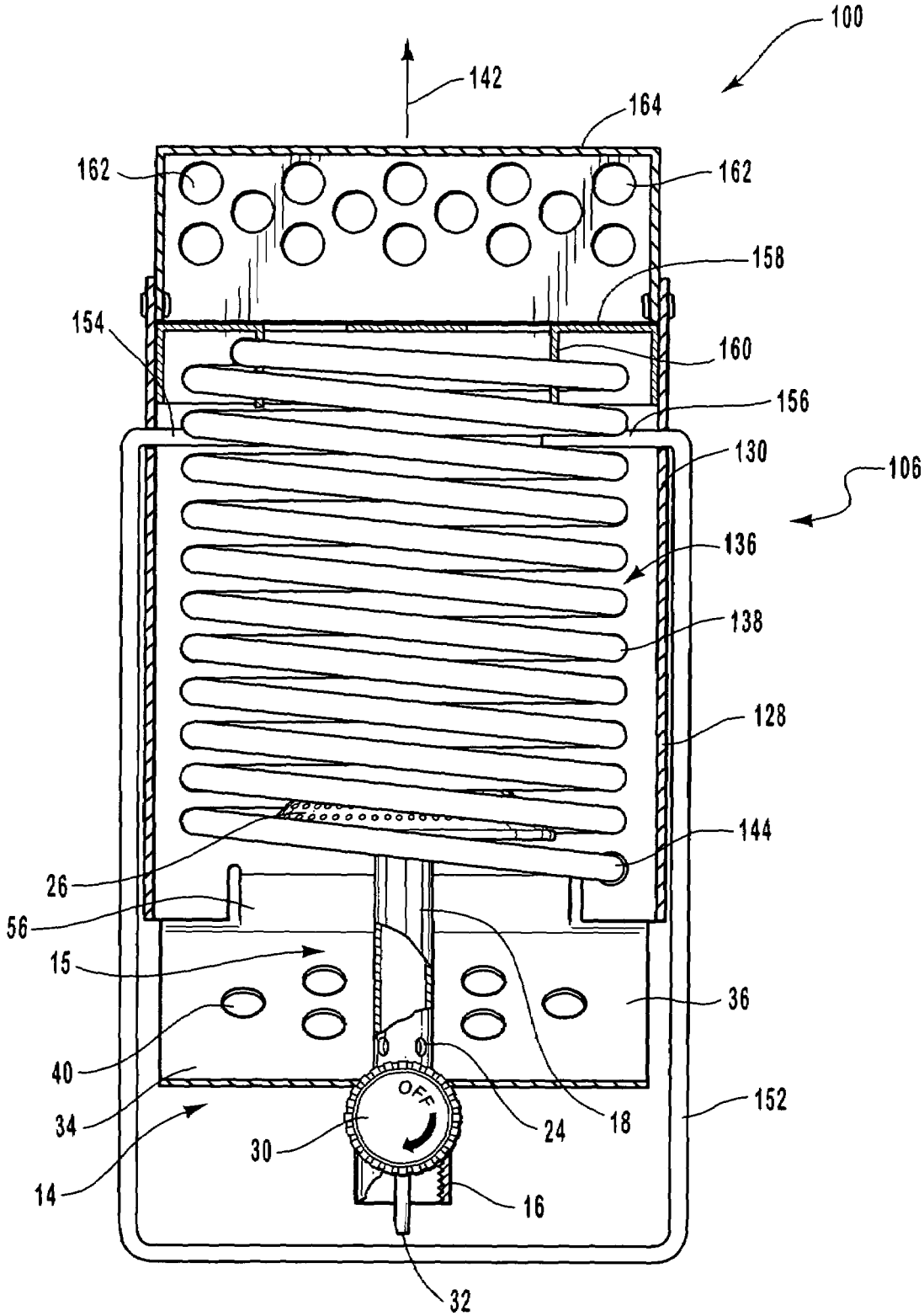
FIG. 9 is a partial cross sectional side view of another embodiment of a water heating attachment.

FIG. 9 depicts another embodiment of heating core 136 for heating assembly 106 of a water heating attachment 100. As illustrated, heating core 136 includes coiled tube 138 in a generally cylindrical shape with substantially only one diameter Z. In other words, heating core 136 is substantially all the same diameter Z. Alternatively, in another embodiment heating core 136 has a conical shape.

In the various configurations for heating core 136, coiled tube 138 is sized and positioned to efficiently heat the water passing there through. In particular, heating core 136 is configured to effectively and efficiently heat the water as it flows to the shower. For example, the individual coils of coiled tube 138 are preferably spaced apart to allow air to flow around the tubes. This space between the coils allows the entire outer surface of the coil to be heated, thereby increasing the efficiency of water heating attachment 100. However, the coils of coiled tube 138 are still spaced close enough to each other to allow heat from one coil to be transferred to an adjacent coil to further increase the efficiency of water heating attachment 100.

In one embodiment, coiled tube 138 is spaced apart by a distance of about 0.25 inches to about 0.125 inches. However, it will be appreciated by one skilled in the art that various other suitable distances may be used to separate the coils. One skilled in the art will appreciate that coiled tube 138 may also be divided into various other numbers of series of coils and that the coils or series of coils may have any suitable diameters. By way of example and not limitation, one skilled in the art will appreciate that coiled tube 138 might alternatively be divided into three or more series of coils and perform the function thereof.

In addition, one skilled in the art will appreciate that one or more of the adjacent coils of coiled tube 138 may touch one another and still perform the function thereof. Further, it will be appreciated that coiled tube 138 may have other suitable arrangements and configurations that are appropriate for the intended use of water heating attachment 100.

Coiled tube 138 is constructed from a material, such as copper, that facilitates rapid heat transfer. It will be appreciated by one skilled in the art that various other suitable types of materials including other metals, such as aluminum or stainless steel may also be used. Additionally, in one embodiment, coiled tube 438 extends generally from the lower portion of housing 128 to the upper portion of housing 128 such that the tubing generally fills heating assembly 106. This configuration advantageously increases the heat transfer achieved by heating core 136 by providing a large amount of surface area of coiled tube 138 while simultaneously minimizing the size of housing 128.

As shown in FIG. 4, a handle 152 is attached to housing 128 of heating assembly 106 to facilitate carrying of water heating attachment 100. Handle 152 is, in one embodiment, pivotally attached to housing 128 and allows heating assembly 106 to be attached to a support if desired. FIG. 8 illustrates in further detail that in one embodiment, handle 152 is attached to housing 128 by inserting a first end 154 of handle 152 through a hole in a sidewall 130 of housing 128, and a second end 156 of the handle through a hole in an opposing sidewall 130. In one embodiment of handle 152, first and second ends 154, 156, respectively, of handle 152 have a length sufficient to extend through the holes in sidewalls 130 and between two adjacent coils of coiled tube 138. Alternatively, as illustrated in FIG. 9, first and second ends 154, 156, respectively, are long enough to extend through the holes in the particular side wall 130 of housing 128 and past the inside diameter of coiled tube 138. However, in this embodiment, by way of example and not limitation, first end 154 and second end 156 are on opposing ends of handle 152 and are not connected. In this particular embodiment, first end 154 and second end 156 of handle 152 are retained therein by conventional movable attachment methods.

Advantageously, in these embodiments first and second ends 154, 156, respectively, of handle 152 help position and secure coiled tube 138 within housing 128. Of course, one skilled in the art will appreciate that handle 152 may be attached to housing 128 in a variety of ways well known in the art. It will also be appreciated that various other configurations of handle 152 are capable of carrying out the function thereof. For example, first and second ends 154, 156, respectively, are not required to extend past the inner diameter of coiled tube 138. In fact, in another embodiment, first and second ends 154, 156, respectively, of handle 152 may only extend just past side wall 130 of housing 128.

Housing 128 also includes an upper inner surface 158, as shown in FIG. 8, disposed near the top of housing 128. In one embodiment of water heating attachment 100, inner surface 158 includes brackets 160 that help hold coiled tube 138 in the desired position. As illustrated, in one embodiment, two brackets 160 are used to hold coiled tube 138 in place. It will be appreciated that various other numbers of brackets 160 could be utilized to hold coiled tube 138 in place. It will also be appreciated by one skilled in the art that various other fastening or retaining methods could be used in housing 128 to retain coiled tube 138 in position.

Housing 128 of heating assembly 106 also includes a plurality of apertures 162 disposed in the upper portion of sidewalls 130 to allow the exhaust gases produced by the burning fuel to exit heating assembly 106, which will be discussed in further detail. Additionally, in one embodiment, housing 128 has a generally flat, planar upper surface 164 that advantageously allows items to be placed on upper surface 164 of heating assembly 106. Advantageously, food, small articles of clothing, or other objects may be heated on upper surface 164 of housing 128 while water heating attachment 100 is operating. Upper surface 164 also helps to prevent rain and other items from entering heating assembly 106 when the water heating attachment is being used outdoors.

It will be appreciated that while apertures 162 are depicted as being round in one embodiment, apertures 162 may have various other shapes and configurations. By way of example and not limitation, apertures 162 may be oval, elliptical, octagonal, square, rectangular, or the like, or any combination thereof. In addition, it is contemplated that upper surface 164 may have apertures 162 formed therein.

Housing 128 also comprises means for selectively coupling water heating attachment 100 to heat source 10. As shown in FIGS. 1 and 4, a notch 166 is formed on a bottom portion of one sidewall 130 of housing 128. A corresponding notch (not shown) is formed on a bottom portion of an opposing sidewall 130. Notches 166 are one example of means for selectively coupling water heating attachment 100 to fuel burner assembly 14. Other examples of means for selectively coupling water heating attachment 100 to heat source 10 include slip fit, snap fit, nut and bolt, hole and pin, latch, screws and other mechanical coupling methods.

In one embodiment, shown in FIG. 4, the upper portions of sidewalls 36 and 38 of shield 34 are separated by generally the same length or width as sidewalls 130 of housing 128 such that fuel burner assembly 14 can be readily attached to heating assembly 106. As a result, the upper portions of sidewalls 36 and 38 of are configured to be inserted into corresponding notches 166 in housing 128 to create a friction engagement of fuel burner assembly 14 to heating assembly 106. It will be appreciated that various other ways of selectively attaching fuel burner assembly 14 to housing 128 could be utilized.

By way of example and not limitation, sidewalls 36 and 38 of shield 34 may be either slightly compressed or expanded to create a more secure connection of fuel burner assembly 14 to heating assembly 106. As illustrated in FIGS. 1 and 4, in one embodiment, notches 166 of housing 128 may include one or more inwardly extending bumps or protrusions 170 that engage sidewalls 36 and 38 of shield 34. Advantageously, this friction and/or compression engagement of fuel burner assembly 14 and heating assembly 106 creates a secure, but releasable connection that allows water heating attachment 100 to be easily assembled and disassembled. Alternatively, in another embodiment, fuel burner assembly 14 and heating assembly 106 may be selectively releasably connected by any suitable means well known in the art such as clips, screws, hinges, welding, glue, and the like.

Advantageously, water heating attachment 100 and heat source 10 efficiently heat the water traveling through heating core 136 because burner 26 is located near coiled tube 138 when heating assembly 106 is coupled to burner assembly 14. Further, in one embodiment, illustrated in FIG. 7, because one or more of the coils of coiled tube 138 decrease in diameter as coiled tube 138 spirals upwardly, at least some if not all of the lower and upper coils are directly exposed to the heat produced by burner 26. Alternatively, where coiled tube 138 forms a generally cylindrical shaped body, such as that illustrated in FIG. 9, coiled tube 138 allows the heat from burner 26 to flow upwardly past the coils without being impeded.

Shield 34 also increases the efficiency of water heating attachment 100 by directing the heat from burner 26 toward coiled tube 138. More specifically, in one embodiment, angled sidewalls 36 and 38 of shield 34, which is typically constructed from metal, assist in directing the heat from burner 26 towards coiled tube 138, and housing 128, which is also typically constructed from metal, also helps direct the heat from burner 26 to coiled tube 138. It will be appreciated that various types of materials capable of withstanding heat may be utilized as the coiled tube 138, housing 128, and/or shield 34.

In one embodiment, illustrated in FIG. 8, upper inner surface 158 of housing 128 helps retain the heat from burner 26 within the housing while allowing the exhaust gases to escape through apertures 162 near the top of sidewalls 130 of housing 128. Thus, heating assembly 106 provides for efficient heating of the water due to the effective heat transfer from the heat source to the water, and the loss of heat from heating assembly 106 is minimized. Returning to FIG. 4, an outlet assembly 172 is attached to outlet 140 to allow the water to flow from heating core 136 to a fixture 134. More specifically, outlet assembly 172 comprises an outlet conduit 174 which is connected to outlet 140. In one embodiment, outlet conduit 174 is comprised of a resilient, flexible material. It will be appreciated that outlet conduit 174 may have various configurations and perform the function thereof. A fixture 134, such as a showerhead, may be attached to outlet conduit 174 depending upon the intended use of water heating attachment 100. It will be appreciated that other suitable types of fixtures 134, or no fixture at all, may be used depending upon the intended use of water heating attachment 100.

As illustrated in FIGS. 3 and 4, in order to assemble water heating attachment 100, fuel burner assembly 14 is connected to fuel source 12, such a pressurized cylinder filled with propane. Water heating attachment 100 may then be connected to fuel burner assembly 14 as described above.

In operation, intake 112 is inserted into or connected to water source 110 such that water is provided to heating assembly 106, and power is supplied to pump 108 by power supply 104. For example, the user can insert intake 112 and pump 108 into a bucket of water as shown in FIGS. 3 and 4, and the user can depress the on/off switch 126 on power supply 104 to turn pump 108 on and draw water from water source 110 through intake 112. The user then turns on heat source 10 by opening gas control valve 28 and igniting the gas either manually or automatically. Thus, water is now flowing through water heating attachment 100 and the water is being heated by heat source 10. One skilled in the art will appreciate that the volume of water being pumped is generally dependent upon the size and speed of pump 108. Thus, the speed or size of pump 108 can be increased to supply a larger volume of water.

In greater detail, the water flows through intake 112, pump 108, intake tube 113, and into heating assembly 106 where the water enters heating core 136. As the water traverses heating core 136, heat from heat source 10 heats the water. In particular, coiled tube 138 absorbs the heat from heat source 10, and transfers the heat to the water as it flows through coiled tube 138. Additionally, as discussed above, coiled tube 138 is spaced apart to facilitate heating of coiled tube 138 and to allowing hot air and gases to flow around coiled tube 138. This arrangement further increases the heat transfer between heat source 10 and coiled tube 138. Advantageously, because heating core 136 has a large surface area, is located proximate to heat source 10, and is constructed from materials that facilitate the transfer of heat, the water is quickly and efficiently heated. The heated water then exits heating assembly 106 through outlet 140 and outlet assembly 172. More specifically, water exits through outlet conduit 174. Outlet conduit 174 is connected to any suitable fixture 134, such as a showerhead, which can be used for any desirable task or undertaking such as a shower.

Once hot water from water heating attachment 100 is no longer needed, the user simply extinguishes heat source 10 by turning control valve 28 into the off position and turning pump 108 off. Extinguishing heat source 10 stops the heating of the water, and turning off pump 108 stops the flow of water through water heating attachment 100. The user can then detach intake tube 113 from either pump 108 or inlet 132 and allow the water to drain from water heating attachment 100. Water heating attachment 100 is now ready to be disassembled, moved or transported. Advantageously, water heating attachment 100 can also be quickly disassembled for storage or transport. For example, heating assembly 106 can be disconnected from fuel burner assembly 14, and fuel burner assembly 14 can be disconnected from fuel source 12. This disconnected state allows the various components to be stored in a relatively small area, such as inside a container described in more detail below.

In accordance with another aspect of the invention, multi-purpose heating unit 8 comprises an air heating attachment 200. As seen in FIG. 1, an air heating attachment 200 may be selectively coupled to burner assembly 14 to provide heated air to a user in a variety of locations. FIGS. 10–17 depict various features of various embodiments of air heating attachment 200. Advantageously, the inventive air heating attachment 200 provides a reliable source of heated air to an enclosed structure, such as a tent or camp trailer, while eliminating the introduction of potentially dangerous exhaust gases, such as carbon monoxide, into the enclosed structure. In addition, air heating attachment 200 is portable and simple to use, which is particularly important when the user is traveling to remote areas.

Figure 10:
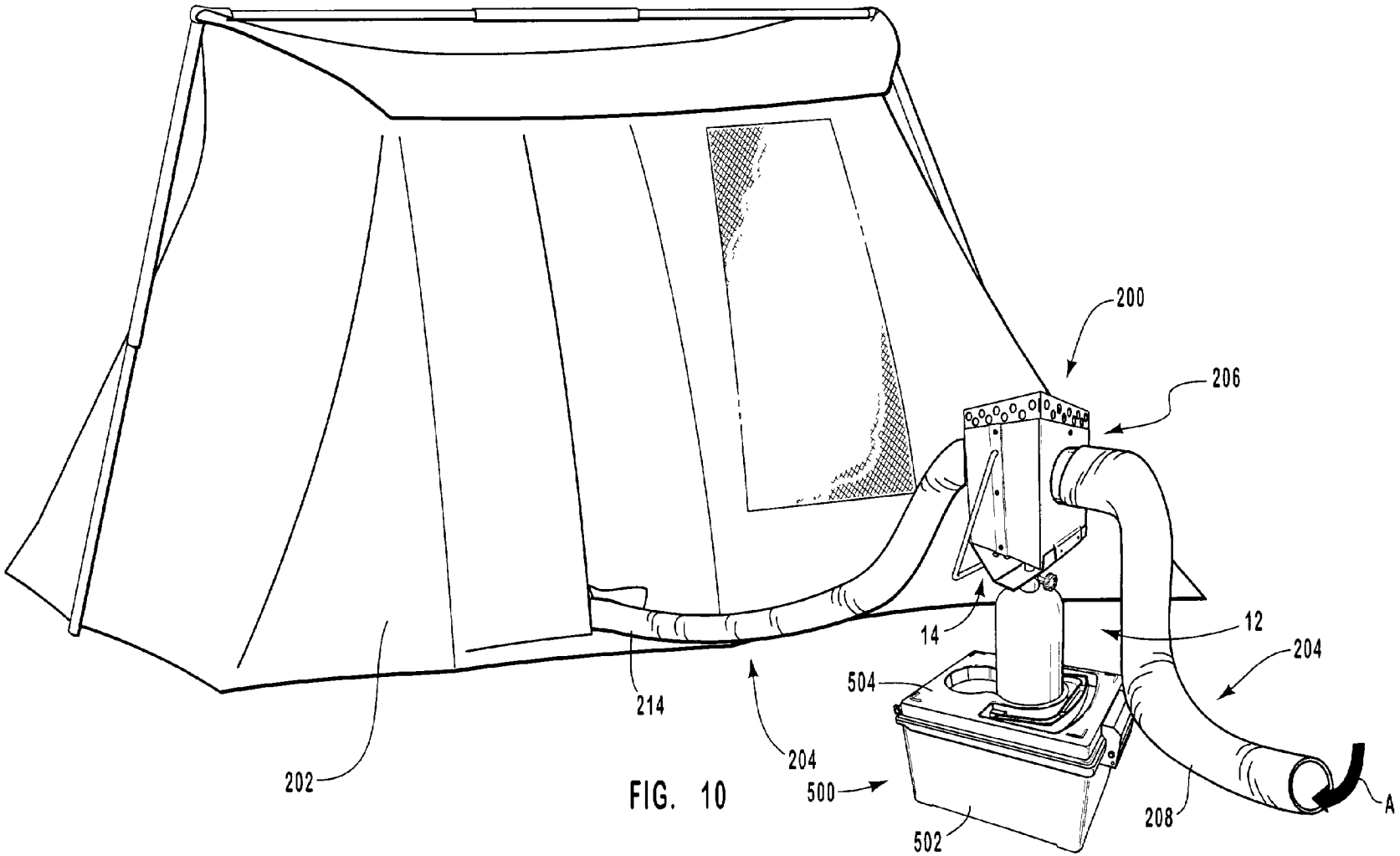
FIG. 10 is a perspective view of one embodiment of the portable multi-purpose heating unit with one embodiment of an air heating attachment and illustrates one example of using the heating system with a tent structure.

FIG. 10 illustrates one embodiment of air heating attachment 200 used for heating an enclosed structure 202, such as a tent, tent trailer, camper or camper trailer, or the like. The discussion herein refers to use of air heating attachment 200 with a tent 202. It will be appreciated by one skilled in the art that this discussion and description of use is equally applicable to other types of enclosed structures, including but not limited to, tent trailers, campers, camper trailers and the like.

FIG. 10 depicts one possible arrangement of air heating attachment 200 being used to heat the interior of tent 202. As can be seen from FIG. 10, air heating attachment 200 is placed near, but not in, tent 202. Multi-purpose heating unit 8 is configured such that the air heated by air heating attachment 200 and blown into tent 202 is isolated from the combustion portion of multi-purpose heating unit 8 producing the heat. In particular, the air heated by air heating attachment 200 is always kept isolated from the exhaust gases, which are vented by air heating attachment 200 into the atmosphere exterior to the tent. Thus, air heating attachment 200 safely heats the interior of tent 202 because it does not introduce harmful exhaust gases, including but not limited to carbon monoxide, into tent 202. In addition to reliably and safely providing heated air to a person or the interior of a structure, air heating attachment 200 may also simultaneously be used to heat things such as food, drinks, small articles of clothing, etc., by placing such things on top of air heating attachment 200, as will be discussed in further detail later on.

Figure 11:
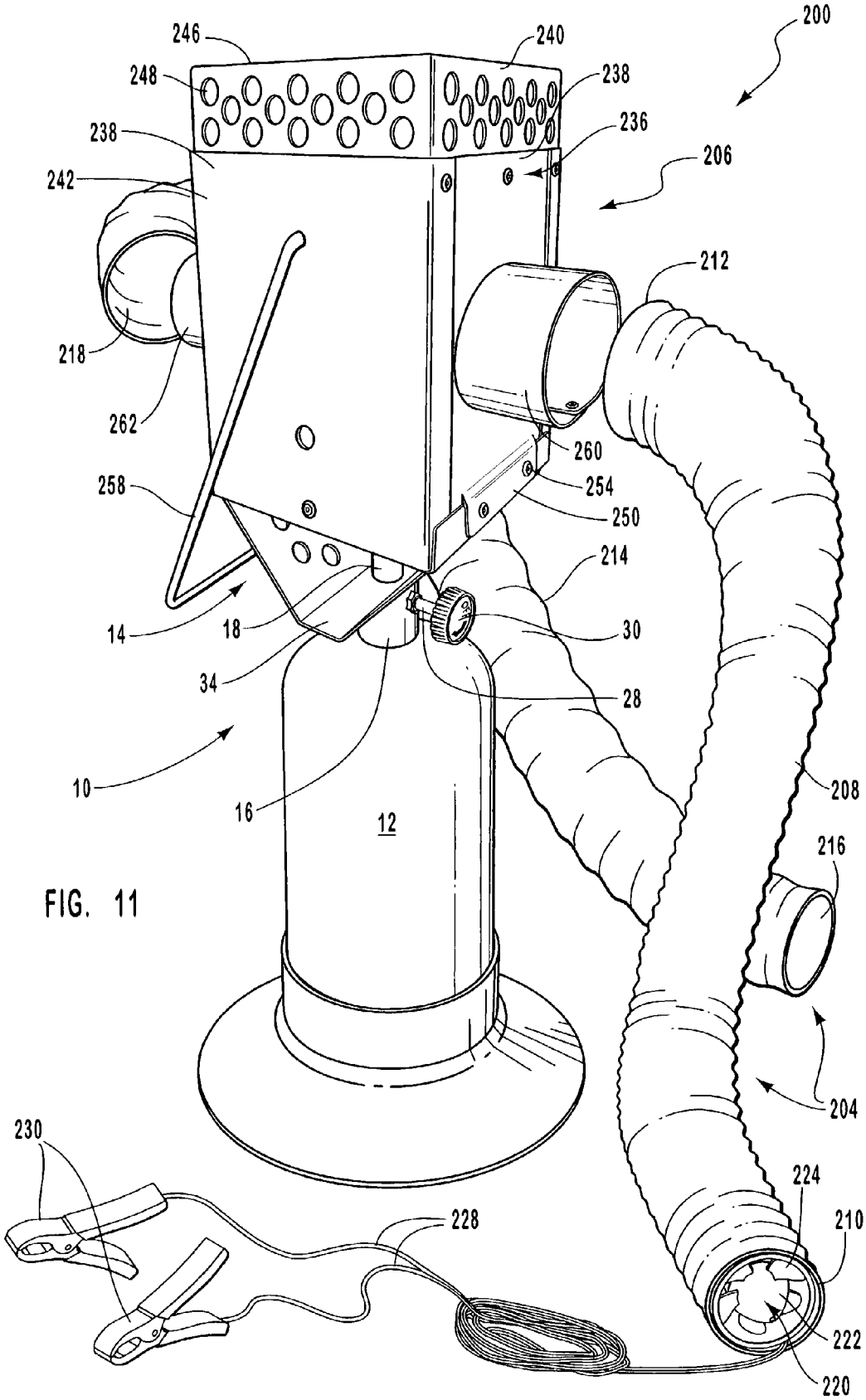
FIG. 11 is a perspective, partially exploded view of the air heating attachment of FIG. 10 in further detail.

In one embodiment depicted in FIG. 11, air heating attachment 200 comprises an air transfer assembly 204 and a heating assembly 206. During operation of air heating attachment 200, which is explained in further detail below, the above components operate in unison to provide a safe supply of heated air for use as desired by the user. Air transfer assembly 204 directs fresh, ambient air into and through heating assembly 206 and into tent 202. In one possible embodiment illustrated in FIGS. 11 and 12A–12C, air transfer assembly 204 includes a hollow air intake conduit 208 having first and second ends 210 and 212, respectively, and a hollow air outlet conduit 214 having first and second ends 216 and 218, respectively. Second ends 212 and 218 of air intake and air outlet conduits 208, 214, respectively, are removably attached to heating assembly 206 to direct a flow of air through heating assembly 206. It will be appreciated by one skilled in the art that while FIGS. 12A and 12B depict air outlet conduit 214, the discussion related thereto substantially applies to air intake conduit 208.

FIG. 10 depicts one possible way of arranging air intake conduit 208 and air outlet conduit 214. As depicted, first end 210 of air intake conduit 208 is positioned outside of tent 202 and draws in ambient air as illustrated by arrow A. Alternatively, it is contemplated herein that in some cases it might be desired to utilize the configuration depicted in FIG. 17, where first end 210 of air intake conduit 208 draws air from the inside of tent or structure 202 into heating assembly 206. This heated air is then blown out air outlet conduit 214 back into tent 202. The effect of this arrangement is recirculating and reheating the air within tent 202.

Figures 12A, 12B, 12C:
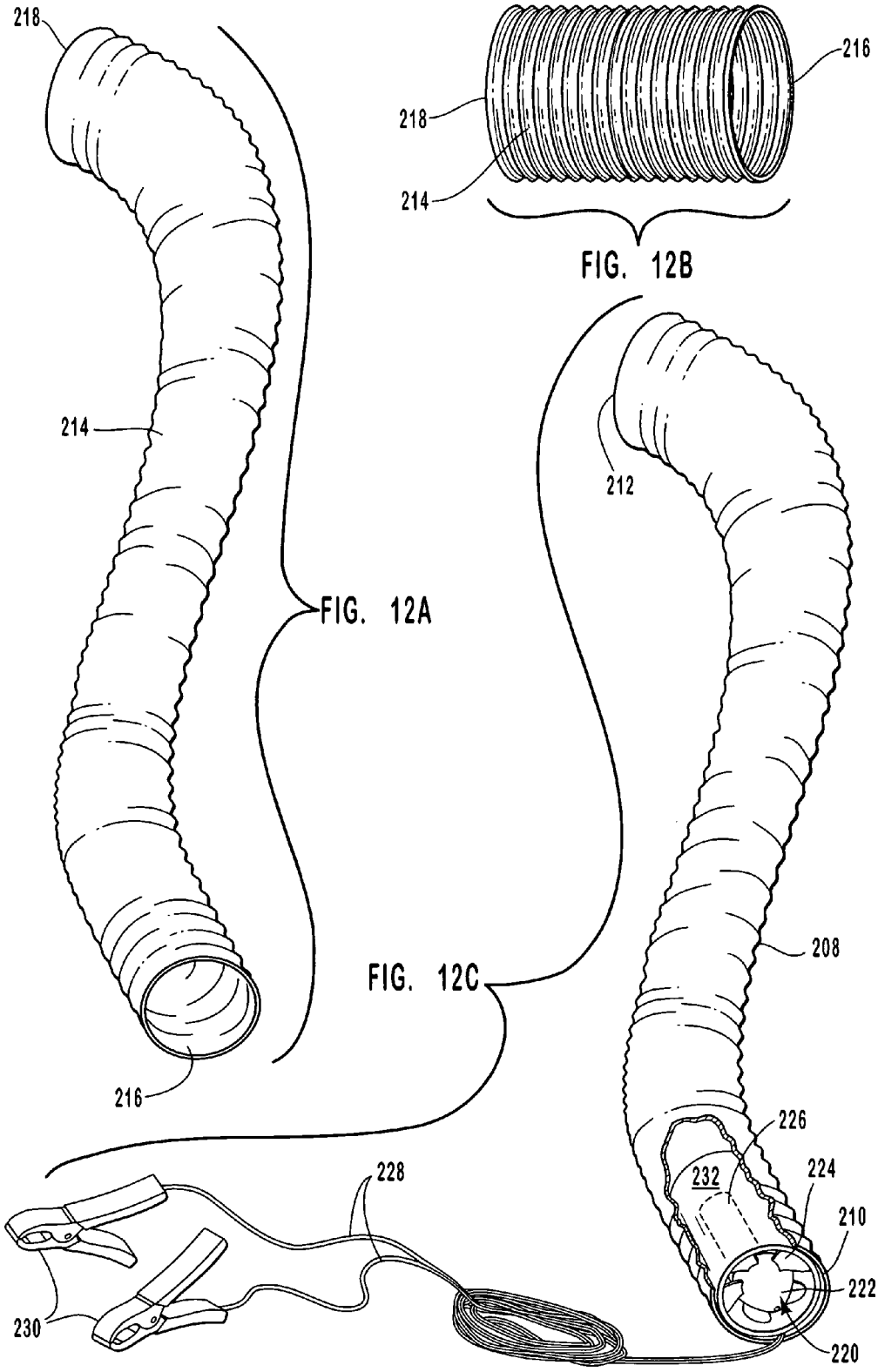
FIG. 12A is a perspective-view of one embodiment of an air outlet conduit of the air heating attachment shown in FIG. 11 in an expanded position.
FIG. 12B is a perspective view of the air outlet conduit shown in FIG. 12A illustrated in a collapsed position.
FIG. 12C is a perspective, partial break away view of one embodiment of an air intake conduit of the air heating attachment shown in FIG. 11 with the air intake conduit in an expanded position.

As depicted in FIGS. 11, 12A, 12B and 12C, air intake and air outlet conduits 208, 214, respectively, are preferably flexible to offer maximum versatility in positioning air intake and outlet conduits 208, 214, respectively, in the desired locations relative to tent 202 and heating assembly 206. In one embodiment, air intake conduit 208, and particularly air outlet conduit 214, may optionally have a heat reflective inner surface to help retain the heat of the air therein. Additionally, air intake and air outlet conduits 208, 214, respectively, may also optionally include a helically wound metallic wire to provide resilient support for the conduits. Advantageously, conduits constructed in this manner are strong enough to maintain their substantially cylindrical shape while under some stress, yet are lightweight and collapsible, as depicted in FIG. 12B, for easy storage and transport.

Further, air intake conduit 208 and air outlet conduit 214 are preferably expandable to any suitable lengths necessary to enable air heating attachment 200 to function properly and safely. For example, in one embodiment, air intake and air outlet conduits 208, 214, respectively, are each approximately two to four feet long when extended to their preferred operating length, but may have any suitable length depending upon the intended use of air heating attachment 200. It will be appreciate by those skilled in the art that various other lengths of air intake conduit 208 and air outlet conduit 214 are capable of performing the function thereof. In addition, it will also be appreciated by one skilled in the art, that while one embodiment of air intake conduit 208 and air outlet conduit 214 depicted in FIGS. 11, 12A and 12C, have the same length, this is not required. Depending on the particular use for air heating attachment 200, it is contemplated that a particular configuration of air heating attachment 200, could utilize air intake conduit 208 and air outlet conduit 214 each having a different length. It will also be appreciated that while air intake and outlet conduits 208, 214, respectively, are depicted as having a substantially cylindrical cross-section, one or the other or both of the conduits could have various other configurations and perform the function thereof.

As can be seen in FIG. 12C, in one embodiment air intake conduit 208 has a motorized fan 220 disposed within its inner volume. More specifically, motorized fan 220 is disposed within first end 210 of air intake conduit 208. It will be appreciated that various types of motorized fans 220 may be utilized in this device. In one possible embodiment illustrated in FIGS. 11 and 12C, motorized fan 220 directs air into air intake conduit 208 such that air travels through air transfer assembly 204. In one embodiment, motorized fan 220 includes an impeller 222 having a plurality of blades 224 and a motor 226. In one embodiment of motorized fan 220 depicted in FIG. 12C, blades 224 are angled relative to the axis of rotation. It will be appreciated that blades 224 could have various other angular positions relative to the axis of rotation, including being perpendicular thereto.

Motorized fan 220 is configured to include a power source. It will be appreciated that various types of power sources could be utilized for motorized fan 220, such as batteries or adaptors to connect motorized fan 220 to a separate power source such as a car battery. In one possible embodiment, illustrated in FIGS. 11 and 12C, motorized fan 220 includes two electrical cable leads 228 that are in electrical communication with motor 226. Electrical cable leads 228 may have any suitable length, such as by way of example and not limitation, approximately 12 feet, and are fitted with clamps 230, allowing motor 226 of motorized fan 220 to be electrically connected to a car battery or similar power source. Motorized fan 220 may also include an on/off switch (not shown) to control the function of the fan during operation of air heating attachment 200.

In another embodiment, electrical cable leads 228 may be electrically connected to a 12 volt cigarette plug configured to cooperate with a car, boat, camper and the like. Alternatively, electrical cable leads 228 may be attached to a rechargeable battery or other suitable power source disposed near the air heating attachment 200 for added convenience and portability. As illustrated in FIG. 12*c*, in one embodiment, motorized fan 220 is structurally supported by and housed in a sleeve 232 comprising thermoplastic or similar material that, in turn, is fixedly disposed within air intake conduit 208 near first end 210 thereof by conventional fastening devices (not shown), such as a coupler. It will be appreciated that although sleeve 232 is cylindrical as depicted in FIG. 12C, sleeve 232 could have various other configurations including square, oval, elliptical, rectangular or various combinations thereof as long as sleeve 232 is configured to be attached to air intake conduit 208.

It will also be appreciated that while motorized fan 220 is depicted as disposed within air intake conduit 208, motorized fan 220 could instead be attached to first end 210 of air intake conduit 208. Various other arrangements are capable of carrying out the intended function thereof. One skilled in the art will appreciate that motorized fan 220 may be disposed in other locations in air heating attachment 200 while still preserving its functionality. Likewise, motorized fan 220 may differ in size and configuration from that explicitly described herein. For example, a fan powered by solar energy could be disposed in air outlet conduit 214 in order to direct air through air heating attachment 200.

Figure 13:
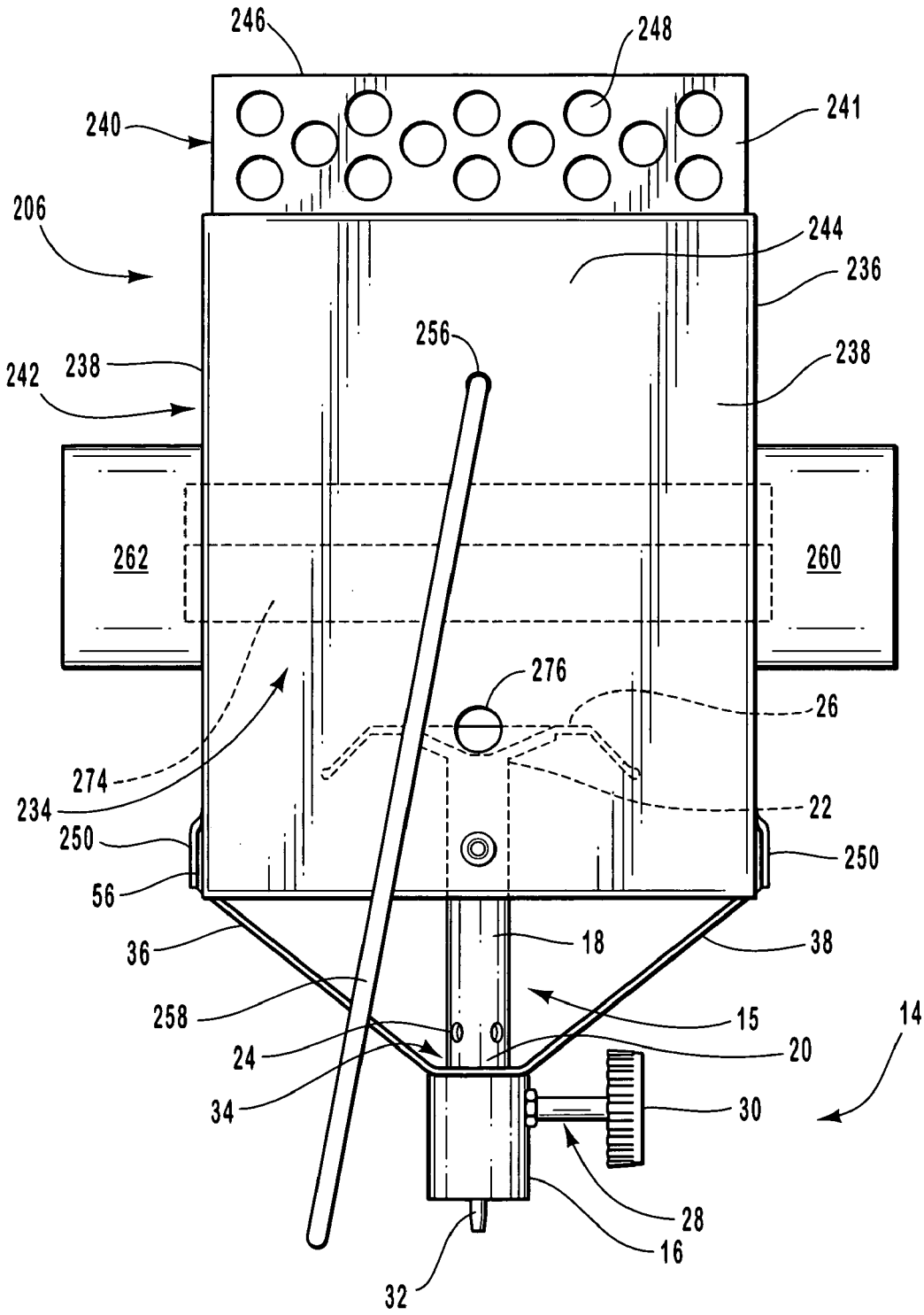
FIG. 13 is a front view of one embodiment of an air heating attachment shown in FIG. 10 with the fuel source and the air intake and outlet conduits removed.
Figure 14:
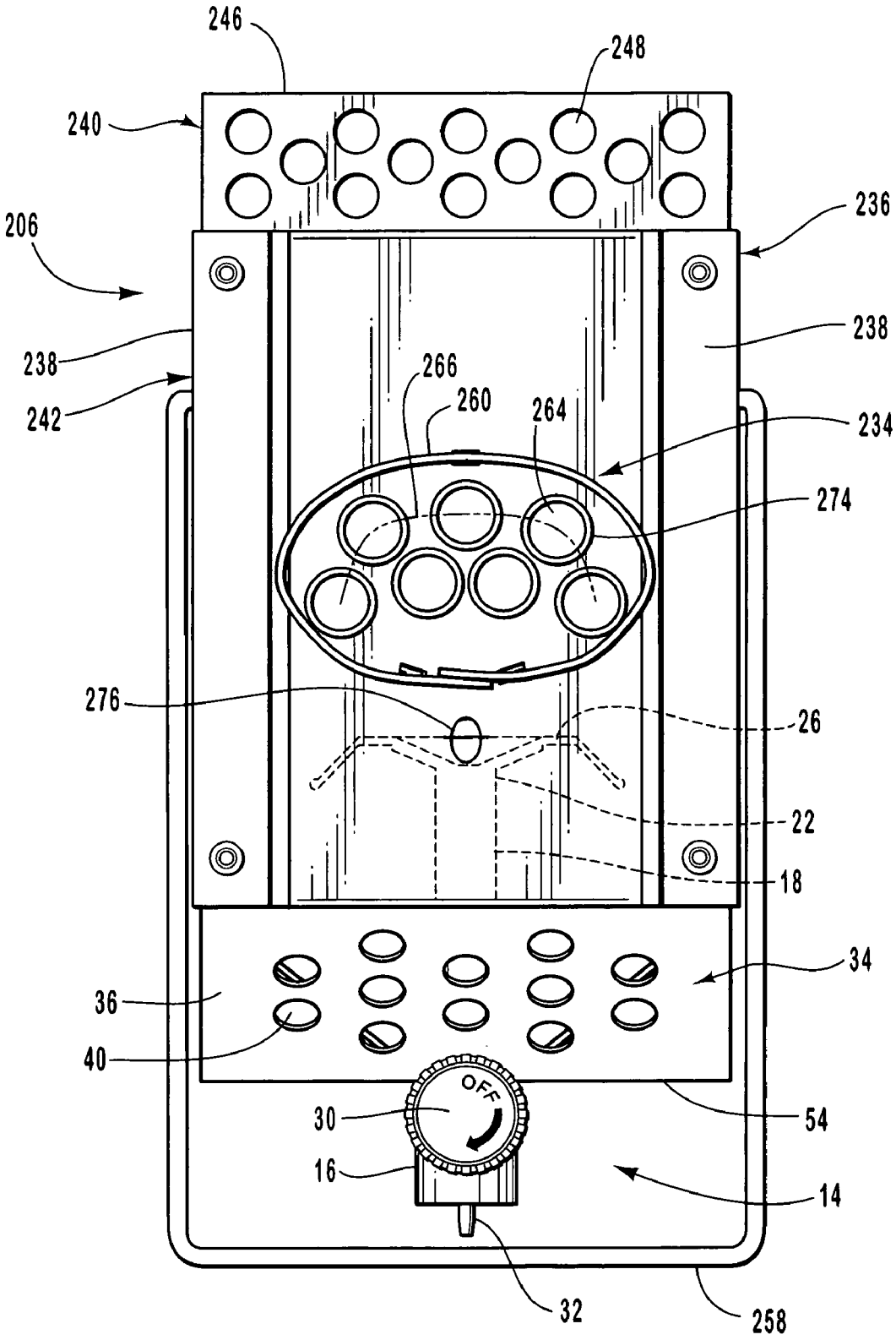
FIG. 14 is a side view of one embodiment of the air heating attachment of FIG. 13.

Reference now is made to FIGS. 13 and 14, which illustrate various features of heating assembly 206. Heating assembly 206 provides an enclosure in which heat produced by combustion of the fuel-air mixture is transferred to air flowing through heating assembly 206. Heating assembly 206 also directs the heat produced by the combustion towards a heating core 234, which will be discussed in further detail below. Heating assembly 206 is preferably composed of a metallic material, such as steel, but one skilled in the art will appreciate that heating assembly 206 could be formed from other materials as well.

In one embodiment depicted in FIG. 11, heating assembly 206 of air heating attachment 200 includes a housing 236. In one embodiment, housing 236 includes four sidewalls 238 and has a generally rectangular configuration. It will be appreciated that housing 236 could have various other numbers of sidewalls 238 and still perform the function thereof. In addition, it will be appreciated that housing 236 could have various other configurations. By way of example and not limitation, housing 236 could be square, cylindrical, oval, elliptical, and the like or combinations thereof. In one embodiment, housing 236 has a length and a width of about five inches and a height of about six inches, but it will be understood that housing 236 may have any desired size depending upon various factors such as the rate at which water is to be heated.

Housing 236 includes an upper end portion 240 and a lower end portion 242. Upper end portion 240 may be integral with lower end portion 242 or fixedly attached to lower end portion 242 using any one of several attachment or fastening methods well known in the art, such as welding or mechanical fasteners. In one embodiment, upper end portion 240 includes walls 241 and a substantially planar top surface 246. Top surface 246, when heated by burner 26 during the operation of air heating attachment 200, may serve as a heating surface for warming things such as food, drinks, small articles of clothing, etc.

Upper end portion 240 also includes a plurality of apertures 248 disposed on walls 241 to allow air and gas to exit heating assembly 206. In one embodiment, walls 241 of upper end portion 240 each have approximately fourteen apertures 248 formed therein for venting combustion gases from heating assembly 206. It will be appreciated that various other numbers of openings could be formed in walls 241 of upper end portion 240 to perform the function thereof. In addition, it will also be appreciated by one skilled in the art that apertures 248 formed in walls 241 could have various other configurations other than round. Apertures 248 could be square, rectangular, triangular, elliptical, octagonal, oval, or numerous other shapes or combinations thereof and still perform the function thereof. It will also be appreciated that apertures 248 could also be formed in top surface 246 of upper end portion 240.

Housing 236 also comprises means for selectively coupling air heating attachment 200 to heat source 10. As shown in FIGS. 1 and 11, a notch 250 is formed on a bottom portion of one sidewall 238 of housing 236. A corresponding notch 250 is formed on a bottom portion of an opposing sidewall 238. Notches 250 are one example of structure capable of performing the function of means for selectively coupling air heating attachment 200 to heat source 10.

As with water heating attachment 100, previously discussed, in one embodiment, shown in FIG. 11, the upper portions of sidewalls 36 and 38 of shield 34 are configured to cooperate with housing 236 such that sidewalls 36 and 38 are to be inserted into corresponding notches 250 in housing 238 of air heater attachment 200. This arrangement creates a friction engagement of fuel burner assembly 14 to heating assembly 206. It will be appreciated that various other ways of selectively attaching fuel burner assembly 14 to housing 236 could be utilized.

By way of example and not limitation, sidewalls 36 and 38 of shield 34 may be either slightly compressed or expanded to create a more secure connection of fuel burner assembly 14 to heating assembly 206. As illustrated in FIGS. 1 and 11, in one embodiment, notches 250 of housing 236 may include one or more inwardly extending bumps or protrusions 254 that engage sidewalls 36 and 38 of shield 34. Advantageously, this friction and/or compression engagement of fuel burner assembly 14 and heating assembly 206 creates a secure, but releasable connection that allows air heating attachment 200 to be easily assembled and disassembled. Alternatively, in another embodiment, fuel burner assembly 14 and heating assembly 206 are releasably connected by any suitable means well known in the art such as clips, screws, hinges, and the like. As illustrated in FIGS. 13–16, sidewalls 238 of housing 236 and upper end portion 240 together define an interior enclosure 244 for burning the fuel and transferring the heat to the air flowing through air transfer assembly 204.

As depicted in FIG. 13, lower end portion 242 of heating assembly 206 has apertures 256 disposed on opposing sidewalls 238 configured to receive the ends of a handle 258. It will be appreciated that various configurations of apertures 256 can be used to perform the same function as long as they are configured to cooperate with handle 258.

Referring to FIG. 11, lower end portion 242 of housing 236 also includes an intake sleeve 260 for receiving second end 212 of the air intake conduit 208. Intake sleeve 260 is attached to one sidewall 238 of housing 236. Correspondingly, lower end portion 242 also includes an outlet sleeve 262 attached to an opposing sidewall 236 of housing 236 for receiving second end 218 of air outlet conduit 214. As best shown in FIG. 14, sleeves 260, 262 comprise hollow, generally rounded members composed of steel, aluminum, metal, or other suitable material. In one embodiment, sleeves 260, 262 are rounded, generally elliptical shaped members. It will be appreciated that various other configurations of sleeves 260, 262 can be used. By way of example and not limitation, sleeves 260, 262 may be round, cylindrical, oval, square, rectangular and parabolic or combinations thereof as long as they are configured to cooperate with air transfer assembly 204.

Returning to FIGS. 10 and 11, when air heating attachment 200 is operation, in one embodiment second ends 212 and 218 of air intake and air outlet conduits 208, 214, respectively, are coupled to intake and outlet sleeves 260, 262, respectively, in a slip fit arrangement. It is noted that a slight deformation of second ends 212 and 218 of air intake and air outlet conduits 208, 214, respectively, may be necessary to accomplish the coupling thereof with the intake and outlet sleeves 260, 262, respectively. Such a deformation is easily accomplished due to the flexible nature of air intake and air outlet conduits 208, 214, respectively. It will be appreciated that while in one embodiment of air heating attachment 200 that is depicted, air intake conduit 208 and intake sleeve 260, and air outlet conduit 214 and outlet sleeve 262, have slightly different configurations (cylindrical as compared to elliptical), these elements could have various other configurations that are designed to cooperate with each other.

The shape of air intake and air outlet conduits 208, 214, respectively, and sleeves 260, 262 are not of particular importance as long as the sleeves cooperate with the conduits. Alternatively, air intake and air outlet conduits 208, 214, respectively, could be coupled with intake and outlet sleeves 260, 262, respectively, by other fastening or connecting methods know in the art, including by way of example and not limitation, mechanical fasteners or tie downs.

Turning now to FIG. 14, disposed on sidewall 238 of housing 236 and located within the boundary of intake sleeve 260, are a plurality of openings 264. Although not shown, there are a corresponding number of similarly configured openings 264 formed on the opposing sidewall 238 of housing 236 within outlet sleeve 262. Openings 264 are arranged in pairs on opposing sidewalls 238 of housing 236. In one embodiment, each opening 264 has a diameter of approximately 0.625 inches. It will be appreciated that various other sizes and configurations of openings could be used to perform the function thereof. In addition, in one embodiment depicted in FIG. 14, seven (7) openings are formed on opposing sidewalls 238, respectively, of housing 236, thereby forming seven opposing pairs of openings. It will be appreciated by one skilled in the art, that various other numbers of openings and correspondingly pairs of openings 264 can be used to perform the function thereof.

In one embodiment, openings 264 are arranged on sidewall 238 of housing 236 with some of openings 264 being in an arc-like formation indicated by line 266. Other openings 264 are positioned around the arc-like arrangement. In one embodiment depicted in FIG. 14, by way of example and not limitation, sidewall 238 has five openings 264 in the arc-like arrangement. As shown, in this particular embodiment, two additional openings 264 are placed under the arc-like arrangement. It will be appreciated that various other arrangements of openings 264 are capable of performing the function thereof. The purpose for such an arrangement of openings 264 will be discussed in further detail below. It will be appreciated that the specific sizes and configurations of openings 264 as described herein comprise one embodiment of the air heating attachment 200, but holes having other sizes, shapes and/or collective patterns may also be used depending, for example, upon the intended use of air heating attachment 200. It will be appreciated that various other numbers and configurations of openings 264 may be used to perform the function thereof. In addition, it will be appreciated that openings 264 may have various dimensions, and that all of openings 264 do not have to be the same size. Likewise, it will be appreciated that various other arrangements of openings 264 may be utilized to perform the function thereof.

As illustrated in FIG. 14, openings 264 on one sidewall 238 of housing 236 form multiple inlets. Similarly, openings 264 on the opposing sidewall 238 of housing 236 form corresponding multiple outlets. It will be appreciated that any number of inlets and outlets may be formed on housing 236. In one embodiment, at least one inlet and outlet is formed on housing 236. It will be appreciated that the inlet(s) and outlet(s) may be disposed on different sidewalls 238 of housing 236. As shown in FIG. 15, openings 264 are disposed substantially parallel on both sides of housing 236. However, it will be appreciated that the inlet(s) and outlet(s) may be configured in any orientation on housing 236 as desired. Heating core 234 is disposed inside housing 236 between the inlet and outlet formed by openings 264.

Heating core 234 may comprise one or more conduits or heat transfer tubes 274. Heat transfer tubes 274 are an example of an isolating means for isolating the air being heated from the exhaust gases. The isolating means comprises a structure providing a conduit through heating assembly 206 which connects air intake conduit 208 to air outlet conduit 214, while isolating the air from the exhaust gases produced by burner 26 as the air flows from intake conduit 208 through heating assembly 206 to outlet conduit 214. Thus, one example of structure which is capable of performing the function of such an isolating means for isolating the air being heated from the exhaust gases are heat transfer tubes 274.

As illustrated, heat transfer tubes 274 extend between each of the pairs of opposing openings 264. Each heat transfer tube 274 absorbs heat emitted by burner 26 during combustion of the fuel, transferring the heat to the air flowing through heat transfer tubes 274. In one embodiment, heat transfer tubes 274 are composed of copper and are configured to connect opposing openings 264 in housing 236. It will be appreciated that heat transfer tubes 274 could be composed of other materials that are capable of absorbing the heat emitted by burner 26 and transferring the same to the air flowing through heat transfer tube 274.

In one embodiment, each heat transfer tube 274 is sufficiently long to allow each heat transfer tube 274 to extend from one opening 264 on one sidewall 238 of housing 236 to the opposing opening 264 on the opposing sidewall 238 of housing 236. In one embodiment, the distance between opposing sidewall 238 is approximately 5.2 inches. It will be appreciated that various other lengths of heat transfer tubes 274 may be used as long as each heat transfer tube 274 is configured to cooperate with opposing openings 264, and isolates the air being heated from the harmful exhaust gases. It will also be appreciated that although each heat transfer tube 274 is illustrated as being a hollow round member, each heat transfer tube 274 could have various other shapes or configurations as long as it is hollow. By way of example and not limitation, heat transfer tube 274 could be oval, elliptical, square, rectangular, or the like, and any combination thereof as long as it is a hollow member.

Another possible embodiment of an isolating means for isolating the air being heated from the exhaust gas is a single tubular member providing a fluid connection from air intake conduit 208 through heating assembly 206 to air outlet conduit 214. By way of example and not limitation sleeves 260, 262 could be one hollow or tubular member extending through heating assembly 206. Another possible embodiment of such an isolating means comprises one or more tubes providing a fluid connection from air intake conduit 208 through heating assembly 206 to air outlet conduit 214, wherein the tubes comprise a hollow member with multiple vertical or horizontal dividers to maximize the length of the pathway through heating assembly 206, and to maximize the surface area of the tubes in contact with the air flowing there through.

In one embodiment illustrated in FIG. 14, the ends of each heat transfer tube 274 are optionally outwardly flared after insertion in the opposing pair of openings 264 formed in housing 236 to secure each heat transfer tube 274 in the desired location and to facilitate the flow of air through heat transfer tubes 274. The diameter of each heat transfer tube 274 is such that the fit between the outer diameter of each heat transfer tube 274 and the perimeter of the corresponding openings 264 are relatively tight, so as to prevent the harmful exhaust gases from contaminating the air being heated. One skilled in the art will appreciate that heat transfer tubes 274 may have other shapes and sizes that are suitable for the intended use of air heating attachment 200.

Figure 16:
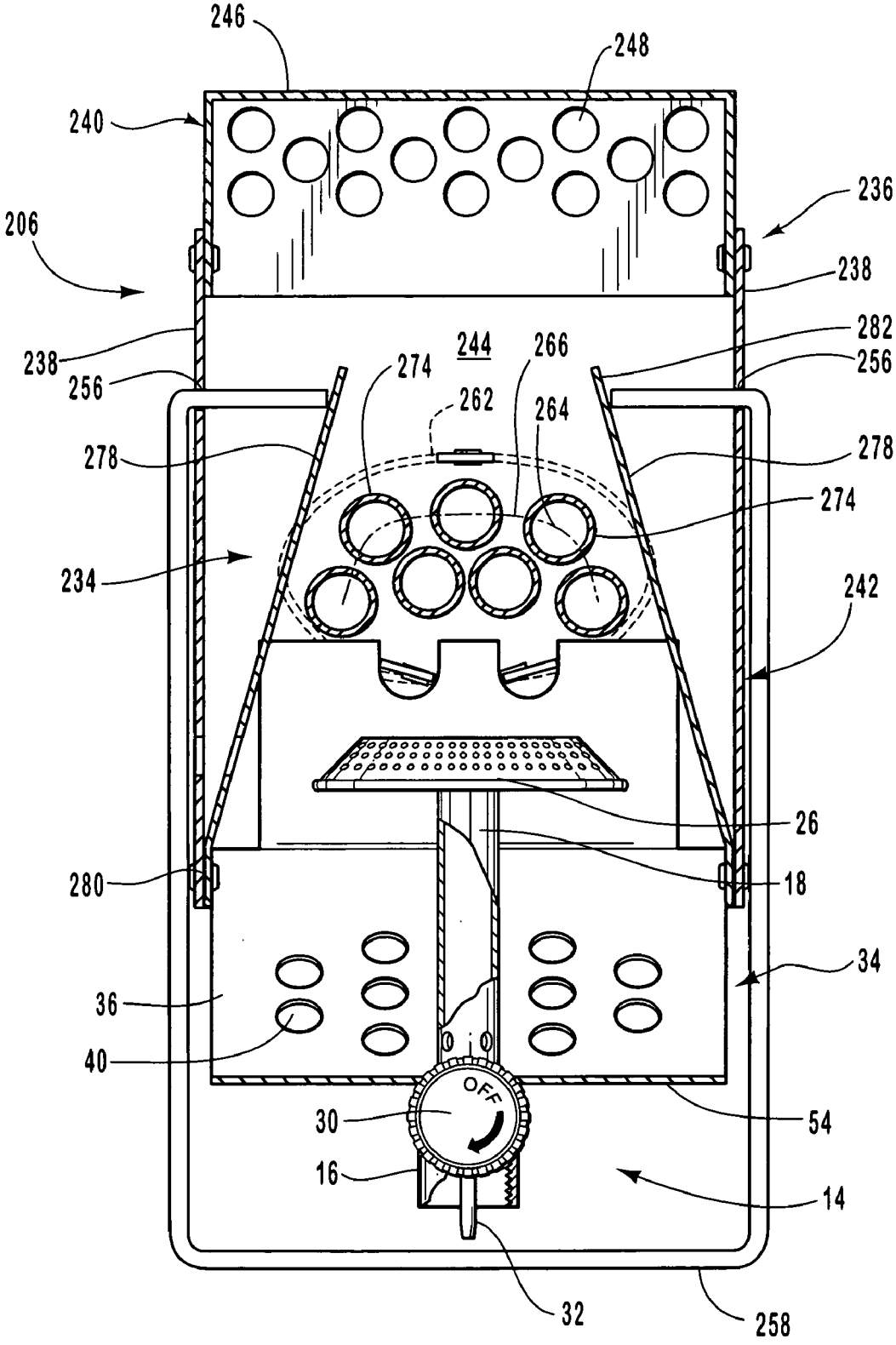
FIG. 16 is a cross sectional side view of the heating assembly of FIG. 15.

As illustrated in FIG. 16, burner 26 may be located within enclosure 244 defined by housing 236, and is proximate to heat transfer tubes 274. A burner access hole 276 (see FIG. 13) may be defined on one or more sidewalls 238 of housing 236 for allowing a user to insert a match to light burner 26 to initiate operation of air heating attachment 200. Alternatively, one skilled in the art will appreciate that other configurations for lighting burner 26 could be employed with air heating attachment 200 in accordance with its intended use. Examples of such other configurations include electric or pizo-electric spark igniters or automatic lighting devices.

As shown in FIG. 16, multiple heat deflectors 278 are located inside heating assembly 206. In one embodiment, two heat deflectors 278 are utilized. It will be appreciated that various other numbers of heat deflectors 278 may be used to carry out the function thereof. For example, a heat deflector 278 may be formed along each sidewall 238 of housing 236 to keep each side of the housing cooler as will be discussed below. Heat deflectors 278 include a first end 280 connected to the inner surfaces of sidewalls 238 of housing 236. Heat deflectors 278 are configured to narrow enclosure of housing 236 in a direction from burner 26 toward heat transfer tubes 274, thereby concentrating the heat produced by burner 26 to an area proximate heat transfer tubes 274. In one embodiment, heat deflectors 278 are composed of spring steel, but it will be appreciated that heat deflectors 278 could be constructed from various other suitable materials known in the art. In addition to directing the heat toward heat transfer tubes 274, heat deflectors 278 also serve as a heat insulator that prevents at least a portion of the heat produced by burner 26 from reaching sidewalls 238 of housing 236, respectively, thereby keeping the surface of housing 236 cooler during operation of air heating attachment 200. Heat deflectors 278 thereby increase the safety of the air heating attachment 200 device by reflecting the heat produced by burner 26 away from housing 236 so that housing 236 is not the primary point of heat contact.

Figure 17:
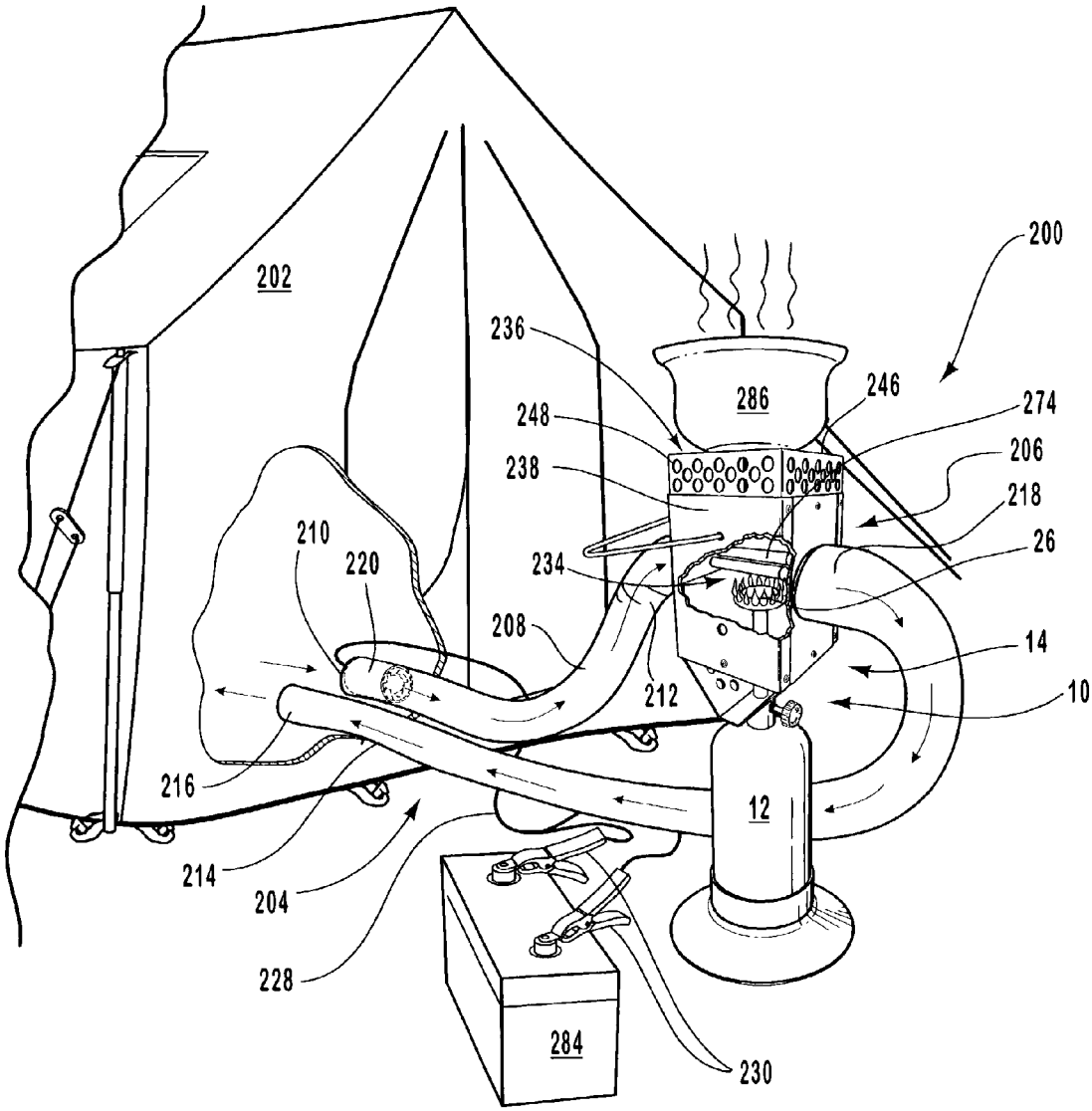
FIG. 17 is a perspective, partial cutaway view of one embodiment of the portable multi-purpose heating unit with an air heating attachment being used in another arrangement for use of the air heating system.

FIG. 17 depicts air heating attachment 200 in another possible configuration for use in conjunction with tent 202. When in operation, air heating attachment 200 produces a continuous supply of heated air to tent 202 in the manner described below. Desirably, the air heated by air heating attachment 200 is free of significant concentrations of harmful and potentially dangerous exhaust gases, and is therefore suitable for heating enclosed structures, such as tent 202.

The following discussion relates to operation of air heating attachment 200. It will be appreciated that while the discussion is referencing FIG. 17, it is also generally applicable to FIG. 10 and the overall operation of air heating attachment 200. As shown in FIG. 17, air heating attachment 200 is selectively coupled to fuel burner assembly 14 which, in turn, is selectively connected to fuel source 12. Fuel source 12 is fitted with one type of a base for providing stability to fuel source 12. Alternatively, as shown in FIG. 10, a container 500 described in more detail below which includes a lid 504 may be utilized to form a base to securely support fuel source 12 and/or heating unit 8. Thus, air heating attachment 200 is disposed stably in a vertical orientation a short distance above the ground.

As seen from FIG. 17, in this particular arrangement or usage of air heating attachment 200, first end 210 of air intake conduit 208 is disposed inside tent 202. First end 216 of air outlet conduit 214 is also disposed within tent 202. In some circumstances, this configuration of the air conduits 208, 214 is desirable if maximum heating of tent 202 is desired. Alternatively, first end 210 of air intake conduit 208 may be disposed outside of tent 202 to maximize the amount of fresh, ambient air being introduced to tent 202, as shown in FIG. 10.

To initiate a flow of heated air to a desired location, a user initially turns on motorized fan 220 by electrically connecting electrical cable leads 228 to an appropriate power source, for example, to a 12-volt car battery 284 via clamps 230 as illustrated in FIG. 17. Alternative power sources include, by way of example and not by limitation, a rechargeable battery pack, a generator, or various other sizes of batteries. The operation of motorized fan 220 draws a flow of air into first end 210 of air intake conduit 208, through air intake sleeve 260, and into heat transfer tubes 274 in heating assembly 206. The air then exits heating assembly 206 via outlet sleeve 262 and passes through air outlet conduit 214, exiting at first end 216 thereof and into tent 202.

Once motorized fan 220 is turned on, the user ignites the fuel at burner 26 by opening fuel valve 28 of connector 16 via knob 30. A match or ignitor ignites the fuel. Lighting the fuel begins a sustained combustion at the surface of burner 26 and creates a large quantity of heat that is transmitted via radiation and convection in a generally upward direction. The heat is concentrated by heat deflectors 278 toward heat transfer tubes 274, which are arranged to maximize heat transfer from the combustion to heat transfer tubes 274.

Heat transfer tubes 274, comprising a thermally conductive material such as, by way of example and not limitation, copper, readily absorb the radiated heat and transmit the heat to the air flowing there through. The heated air continuously flows into tent 202 via air outlet conduit 214, thereby heating the interior of tent 202. If air heating attachment 200 is used according to the configuration shown in FIG. 17, warm air existing in tent 202 is then recirculated into air heating attachment 200 via air intake conduit 208 and heated again before flowing back into tent 202. In this way, air heating attachment 200 is able to take advantage of previously heated air in tent 202, thereby providing even more warmth for the user.

Alternatively, first end 210 of intake conduit 208 may be disposed exterior to tent 202 as illustrated in FIG. 10, taking care not to place it near heating assembly 206 where harmful exhaust gases may be present, to introduce ambient outside air into tent 202. The user may also vary the rate of combustion at burner 26, and hence the rate at which air heating attachment 200 heats air, by varying the flow of fuel through valve 28 via an adjustment to knob 30. It will be appreciated that an optional speed control may be added to motorized fan 220 to control the flow of air flowing through air heating attachment 200.

After transmitting a significant portion of its heat to heat transfer tubes 274, the remaining heat and exhaust gases produced by burner 26 continue to rise past heat transfer tubes 274 to top surface 246. This remaining heat and exhaust gases heat top surface 246, then safely exit into the atmosphere via apertures 248 in top surface 246 or via the vent apertures 248 disposed on upper end portion 240 of housing 236. Heated top surface 246 may be used as a heating surface for such things as food or water placed in a container 286. Air heating attachment 200 can be used in adverse weather without the rain or snow from gaining access to the burner because of the configuration of heating assembly 206 and particularly surface 246. Further, because the exhaust gases produced by burner 26 are isolated from air transfer assembly 204 during operation of air heating attachment 200, the heated air flowing through air transfer assembly 204 is free from contamination by the harmful exhaust gases.

In addition to heating an enclosed structure such as a tent, air heating attachment 200 may also be used as a body warmer by directing the flow of heated air from air outlet conduit 214 directly onto a person. It is also understood that burner 26 may be turned off by the user at any time during operation of air heating attachment 200, thereby allowing unheated air to flow through the air transfer assembly 204 and into tent 202.

It will be appreciated from the foregoing discussion of the heating core 136 of water heating attachment 100 and heating core 234 of air heating attachment 200 that one of skill in the art could design a combined water/air heating attachment according to the teachings disclosed herein. In such an attachment, it will be appreciated that a housing would have an inlet, outlet, and a heating core extending there between. As such, water or air, or any other suitable gas or liquid could be heated by such a heating attachment. It will be appreciated that such an embodiment would be useful in decreasing the number of attachments that the user is required to transport. Furthermore, such an embodiment would be useful in decreasing the weight of multi-purpose heating unit 8.

In accordance with a further aspect of the present invention, multi-purpose heating unit 8 comprises a cooking attachment 300 as depicted in FIG. 1. Cooking attachment 300 includes cooking surface 302 and an attachment portion 304. In the embodiment of FIG. 1, cooking surface 302 is a generally planar surface 306. Cooking surface 302 is shown having four sides 307. It will be appreciated that while cooking surface 302 is depicted as being substantially square in one embodiment, cooking surface 302 may have various other shapes and configurations. By way of example and not limitation, cooking surface 302 may be oval, elliptical, octagonal, square, rectangular, or the like, or any combination thereof. Planar surface 306 may have a plurality of apertures 308 formed thereon. Apertures 308 assist heat from fuel burner assembly 14 in more directly contacting a cooking container that is resting on cooking surface 302.

One skilled in the art will appreciate that the cooking surface 302 can have other suitable configurations depending, for example, upon the desired use of the cooking attachments. For example, cooking surface 302 may comprise a grilling surface formed from a series of rails and having a series of apertures formed there between. In another example, cooking surface 302 may comprise a substantially planar surface 306 without any apertures formed thereon so as to form a continuous surface for frying food. In yet another example, cooking surface 302 may comprise a bowl structure for heating water or other liquids.

Attachment portion 304 of cooking attachment 300 is provided to selectively couple cooking attachment 300 to fuel burner assembly 14. In one embodiment of cooking attachment 300, illustrated in FIG. 1, attachment portion 304 comprises two downwardly extending arms 310 formed on opposing sides 307 of cooking surface 302. Arms 310 have a notch 312 formed on a bottom portion thereto which is configured to fit over vertical portion 56 of sidewalls 36, 38 of shield 34 to create a friction engagement of fuel burner assembly 14 to cooking attachment 300. Further, notches 312 of arms 310 may include one or more inwardly extending bumps or protrusions 314 that engage sidewalls 36 and 38 of shield 34. Advantageously, this friction and/or compression engagement of fuel burner assembly 14 and cooking attachment 300 creates a secure, but releasable connection that allows the cooking attachment to be easily connected and disconnected.

It will be appreciated that various other ways of attaching cooking attachment 300 to fuel burner assembly 14 could be utilized as long as it is configured to cooperate with fuel burner 14. In the embodiment of FIG. 2, where vertical portion 56 of sidewalls 36, 38 of shield 34 comprises notches 46, corresponding notches would not be necessary on arms 310 of cooking attachment 300. As such, cooking attachment 300 can frictionally engage notches 46 of shield 34. Arms 310 of cooking attachment 300 are preferably separated by generally the same distance as sidewalls 36 and 38 of shield 34 such that cooking attachment 300 can be readily attached to heating element 15.

Figure 18:
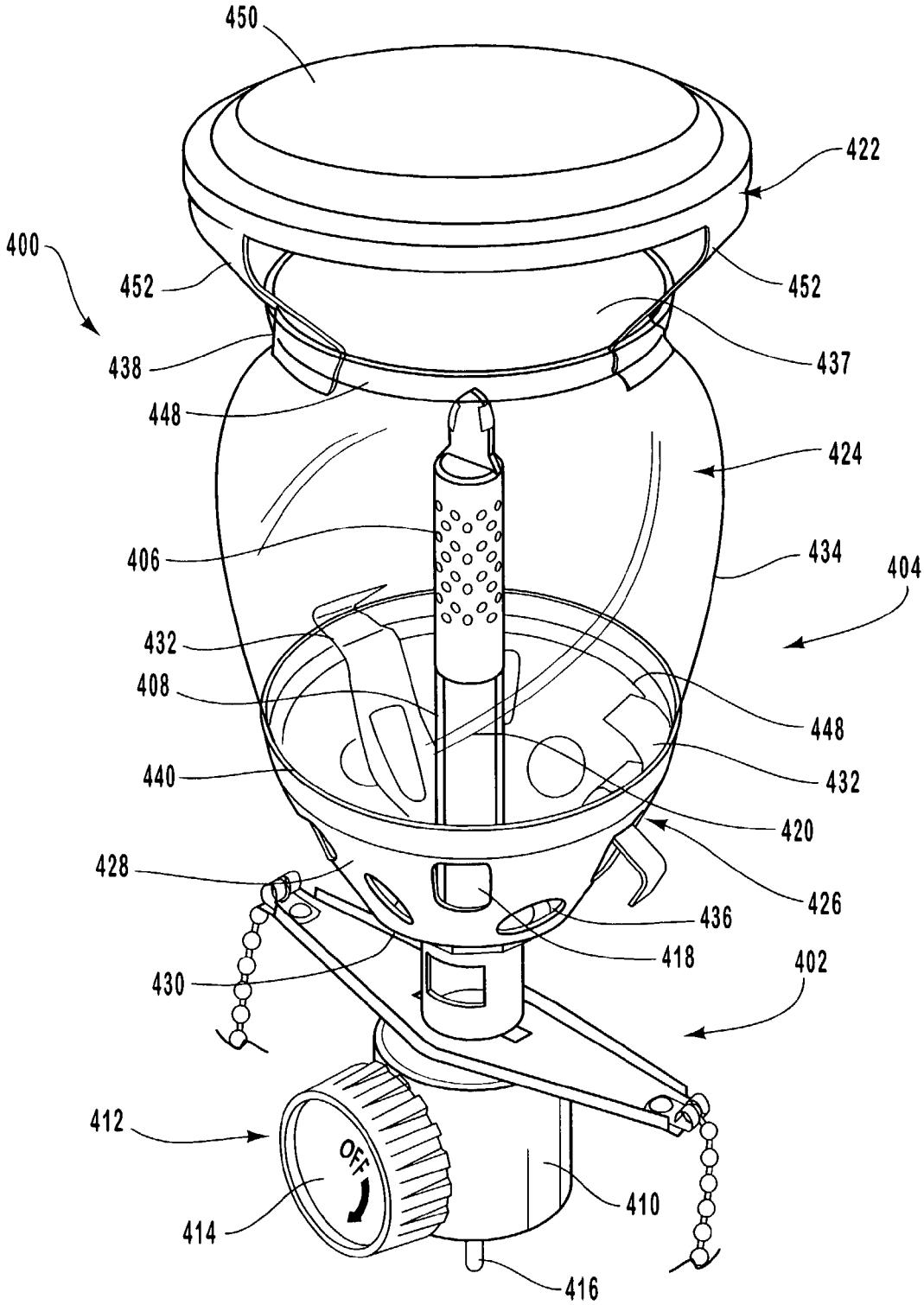
FIG. 18 is a perspective view of one embodiment of a light source attachment for use with the portable multi-purpose heating unit.

With reference now to FIG. 18, multi-purpose heating unit 8 further comprises a light source attachment 400 which may be selectively interchangeable with any of the other attachments heretofore described. In one embodiment of light source attachment 400, depicted in FIG. 18 light source attachment 400 comprises a fuel burner assembly 402 having a shield 404 disposed thereon.

Fuel burner assembly 402 comprises a burner 406, a fuel conduit 408, and a connector 410 that contains control valve 412 therein that controls the flow of fuel from fuel source 12 to fuel burner assembly 402. Control valve 412 has a control knob 414 attached thereto and is disposed in connector 410 to selectively control the flow of fuel through connector 410. A needle 416 extends from connector 410 into the outlet of fuel source 12 (not shown) to enable fuel from the fuel source to flow into connector 410. Connector 410 connects fuel burner assembly 402 to fuel source 12. In one embodiment, connector 410 is connected to fuel source 12 by threads (not shown) that allow fuel burner assembly 402 to be releasably connected to fuel source 12. Connector 410 includes a control valve 412.

Connector 410 connects fuel source 12 to a fuel conduit 408. Fuel conduit 408 has a first end 418 and a second end 420. Fuel conduit 408 also includes openings (not shown) that are spaced about fuel conduit 408 to allow air to be mixed with the fuel to promote efficient burning of the fuel. Openings in fuel conduit 408 are intended to allow air to mix with the fuel to achieve efficient burning of the fuel. Accordingly, the openings are sized and configured to create the proper air-fuel mixture for efficient combustion of the fuel. Burner 406 is attached to the second end 420 of fuel conduit 408 and includes a plurality of openings to release the fuel-air mixture where the flame will occur.

In one embodiment, shield 404 of light source attachment 400 comprises an upper portion 422, an intermediate portion 424, and a lower portion 426. Lower portion 426 is shown having a hemispherical-shaped wall 428 structure with a bottom surface 430 formed on a bottom portion thereof. Wall 428 may comprise a plurality of openings 436 formed thereon to allow air to be introduced to burner 406 of fuel burner assembly 402. It will be appreciated that while openings 436 are in one embodiment depicted as being round, openings 436 may have various other shapes such as being oval, elliptical, square, rectangular, octagonal or the like, or combinations thereof. Advantageously, lower portion 426 allows a large quantity of air to be introduced into fuel burner assembly 402 while also protecting burner 406 from damage and generally preventing the user or other objects from touching the burner or contacting the burning gas.

In one embodiment, lower portion 426 is selectively attached to fuel burner assembly 402 by threading bottom surface 430 to fuel conduit 408. Other means for selectively or permanently attaching shield 404 to fuel burner assembly 402 may be utilized such as, but not limited to, clips, rivets, screws, hinges, welding, glue, and the like. Lower portion 426 may also comprise one or more brackets 432 for securing intermediate portion 424 to lower portion 426.

Intermediate portion 424 of shield 404 comprises a transparent or semitransparent cylindrical surface 434 substantially surrounding burner 406. Cylindrical surface 434 is preferably constructed of a glass compound to provide both the translucency required to provide light but also to withstand the heat emitted by burner 406. Cylindrical surface 434 thus comprises an opening 437 at a first end 438 and a second end 440 thereof for allowing air to be introduced to burner 406. Cylindrical surface 434 may also optionally have a rim 448 formed at each end 438, 440 for selectively attaching transparent cylindrical surface 434 to upper portion 422 and lower portion 426 of shield 404.

Upper portion 422 of shield 404 is shown in FIG. 18 as comprising a generally planar surface 450 with a plurality of brackets 452 depending there from. Upper portion 422 preferably protects opening 436 formed in first end 438 of intermediate portion 424. Brackets 452 are provided to secure upper portion 422 to rim 448 of intermediate portion 424. Brackets 452 preferably space planar surface 450 of upper portion 422 from rim 448 of intermediate portion 424 so as to allow sufficient air to enter opening 437.

In another embodiment, light source 400 may be configured to be selectively attachable to fuel burner assembly 14 depicted in FIG. 1, as discussed above with will be appreciated that lower portion 426 of shield 404 would need to be reconfigured such that it can selectively couple with vertical portions 56 of sidewalls 36, 38 of shield 34. In addition, upper portion 422 and intermediate portion 424 of shield 404 may need to be reconfigured to fit the size of shield 34. As such, it will be appreciated that light source 400 may be configured to be selectively attached to shield 34 of fuel burner assembly 14. In yet another embodiment, shield 34 of fuel burner assembly 14 may be replaceable by a transparent shield similar to that described with respect to shield 404.

Light source attachment 400 desirably allows the multi-purpose heating unit 8 to provide light, which may be very useful when conducting outdoor activities such as camping or climbing. Advantageously, because the fuel burner assembly 402 allows the flow of gas to be readily controlled, the intensity of the light source attachment 400 can also be readily controlled.

Figure 19:
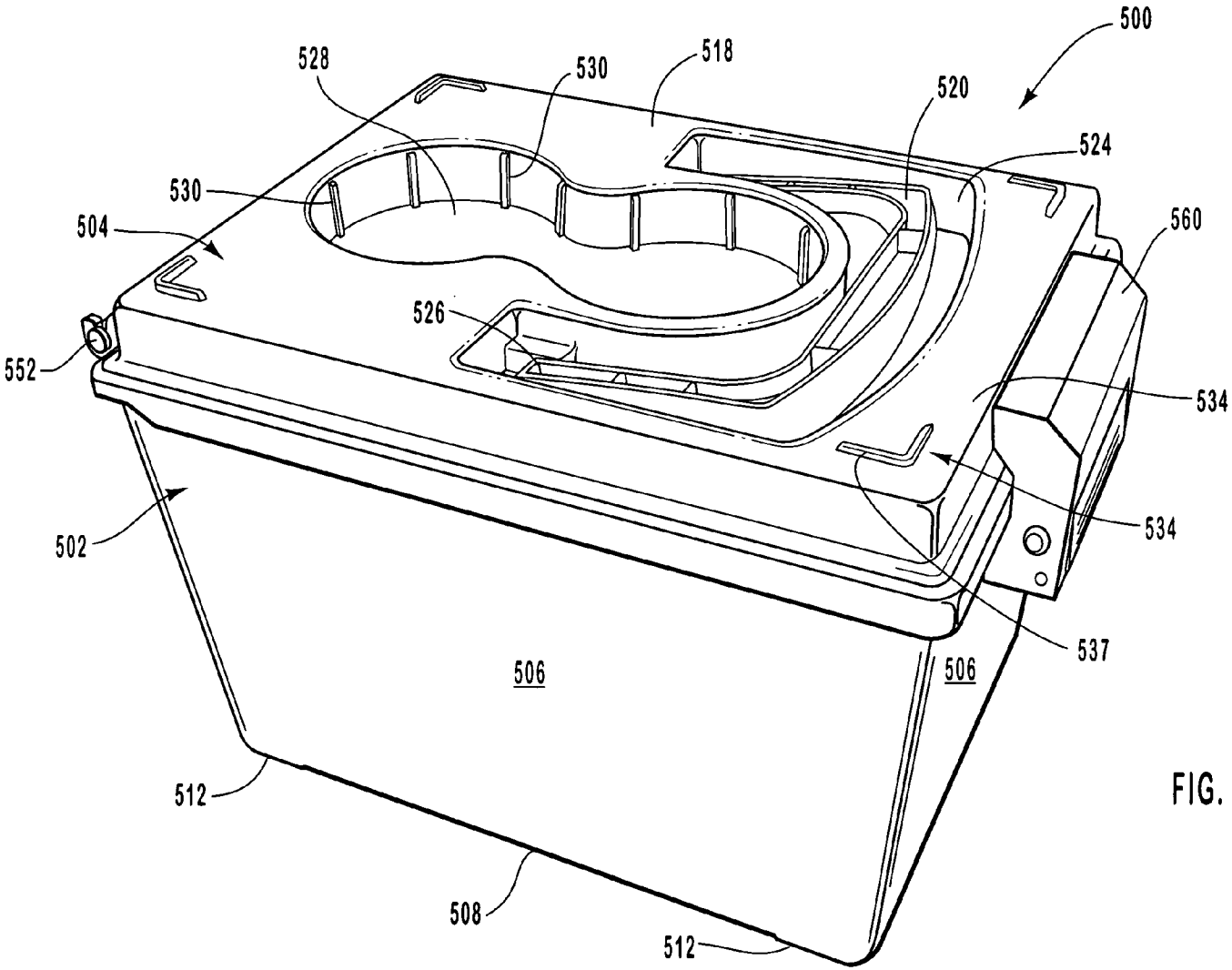
FIG. 19 is a perspective view of one embodiment of a container that may be used in conjunction with the portable multi-purpose heating unit, illustrating the container in a closed position.
Figure 20:
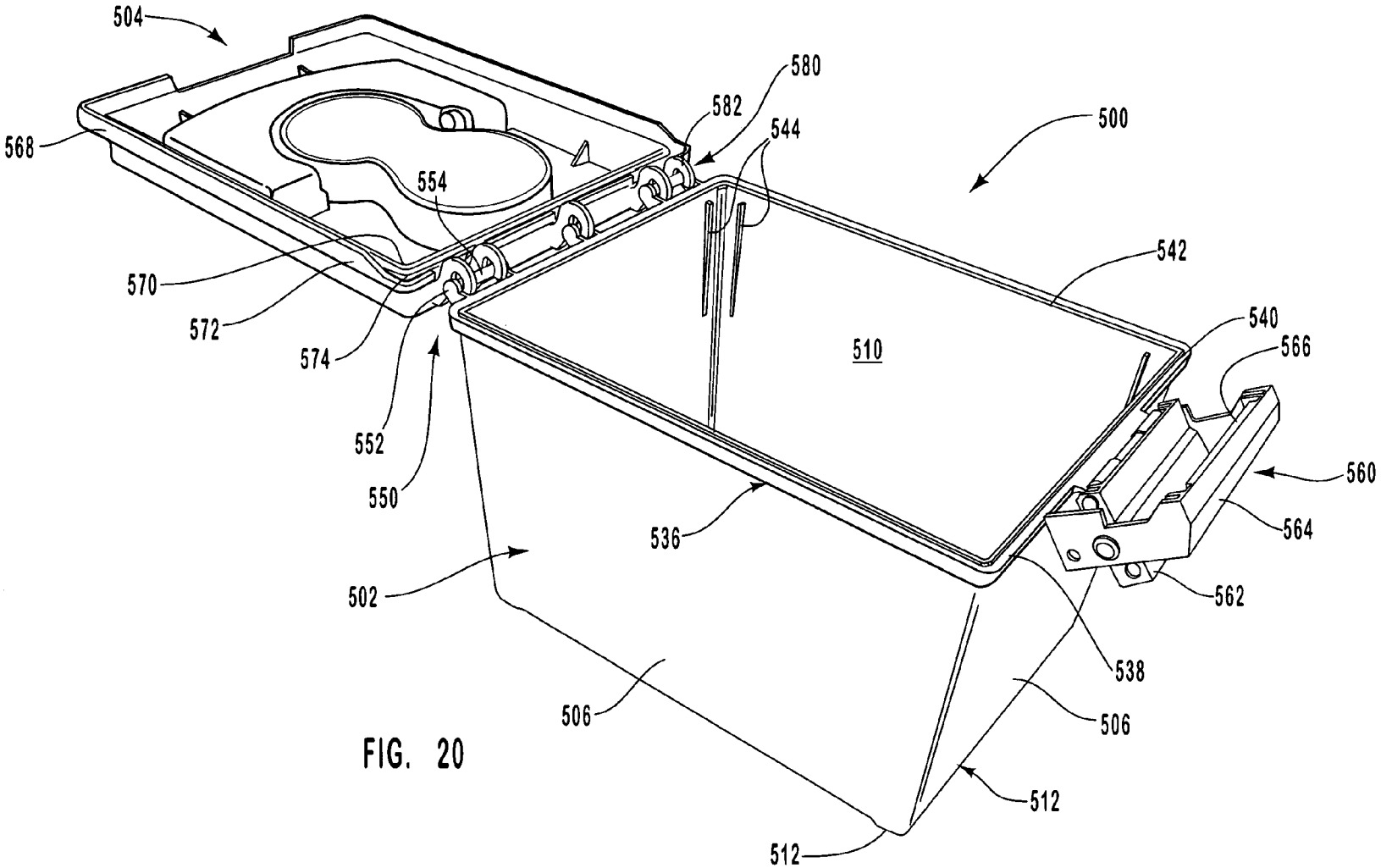
FIG. 20 is a perspective view of the container shown in FIG. 19, illustrating the container in an open position.

As illustrated in FIGS. 19 and 20, container 500 for multi-purpose heating unit 8 has a body 502 and a lid 504. In one embodiment, body 502 has a generally rectangular shape with generally upwardly extending walls 506, which generally define an enclosed interior space 510. It will be appreciated that body 502 may have various other shapes including by way of example and not limitation, square, round, oval, octagonal and the like.

In one possible embodiment, by way of example and not limitation, body 502 has a length of about 12 inches, a width of about 9 inches and a height of about 9 inches. It will be appreciated that body 502 may also have various other dimensions depending upon various factors such as the size of the equipment to be stored inside container 500 or the desired volume of enclosed space 510. Any one or all of the height, width and length may be varied without effecting the function thereof. It is contemplated, however, that the size of body 502 is limited inasmuch as container 500 is "portable."

Container 500 may include various optional features intended to help to stabilize container 500 when it is placed on a surface, and to aid in vertically stacking several containers 500 one on top of another. In one embodiment depicted in FIG. 19, body 502 includes one or more optional feet 512 that extend downwardly from the bottom surface of container 500. It will be appreciated that feet 512 may have various sizes and configurations and still perform the function thereof. In one embodiment, feet 512 are generally square-shaped. Feet 512 are configured to support container 500 in a slightly elevated position. Feet 512 are desirably located in or near the corners of body 502. In a stack of containers 500, feet 512 may also be used to help retain container 500 in the stacked position by being sized and configured to engage a portion of a lid 504 of a lower-positioned container 500, as will be described below.

Container 500 may also include an optional support structure (not shown) located on the bottom surface (not shown) to strengthen the body 502 of the container. The support structure may be used to increase the strength and carrying capacity of container 500 by reinforcing the bottom surface. In one possible embodiment, the support structure includes a plurality of strengthening ribs that extend along the length and width of the bottom surface of the container 500. One skilled in the art will appreciate that various other configurations of support structures and other types of support structures may be used. Additionally, other portions of container 500, such as the sidewalls or lid, may include similar support structures to increase the strength of container 500.

In one embodiment of container 500 illustrated in FIG. 20, the remote upper end of walls 506 includes a lip 536 that extends around the open end of enclosed interior 510 of body 502. Lip 536 comprises an outwardly extending portion 538, an upper surface 540 and an upwardly extending section 542. In one embodiment, upper surface 540 of lip 536 is angled slightly inward as one moves toward upwardly extending section 542, which is located on upper surface 540 of lip 536 along the inside surface of enclosure 510. In one embodiment, the outer most edge of upper surface 540 of lip 536 and upwardly extending section 542 have generally the same height. In another possible embodiment, upwardly extending section 542 extends above upper surface 540 of lip 536. It will be appreciated that lip 536 of body 502 may have various other configurations and perform the function thereof.

In one embodiment, the interior surfaces of walls 506 defining enclosure 510 are generally smooth to facilitate storage, insertion, and removal of items in enclosed space 510 of body 502. In one embodiment, inside surfaces of walls 506 include an optional reinforcing members 544 that are configured to reinforce or strengthen the corners of body 502 of container 500. One possible embodiment of reinforcing members 544 is shown and is disposed near the corners of enclosure 510 defined by walls 506 of body 502. It will be appreciated by one skilled in the art that various other configurations of reinforcing members 544 may be utilized. In one embodiment, reinforcing members 544 is depicted as elongated rib-like members. It will be appreciated that reinforcing members 544 may have various other shapes. Further, as depicted in FIG. 20, in one embodiment reinforcing members 544 comprise two elongated members, one on each side of a corner area. It will be appreciated that, alternatively, reinforcing members 544 could be in the form of one wide member to reinforce the corner area or various other numbers and/or shapes of reinforcing members 544 could be used to provide additional structural support to the corners of body 502.

Container 500 also comprises lid 504 capable of rotating between a closed position illustrated in FIG. 19 and an open position depicted in FIG. 20. Lid 504 is also capable of being selectively detached entirely from body 502 as will be discussed. Various methods and structures for selectively, rotatably and removably attaching one structure to another are well known in the art. Accordingly, it will be appreciated that various such structures or methods may be used in conjunction with the present invention without departing from its spirit and scope.

In an alternate embodiment, lid 14 does not rotate. Instead, lid 14 is manually lifted away from body 12 to move into the open position so that body 12 is accessible. In this embodiment, lid 14 is mechanically held in the closed position by a second clasp 60. Alternatively, it will be appreciated by one skilled in the art that lid 14 could be formed of a resilient material that can snap fit onto body 12. Accordingly, it will be appreciated by those skilled in the art that various other methods of attaching lid 14 to body 12 may be utilized which would allow lid 14 to move between an open position and a closed position.

Figure 21B:
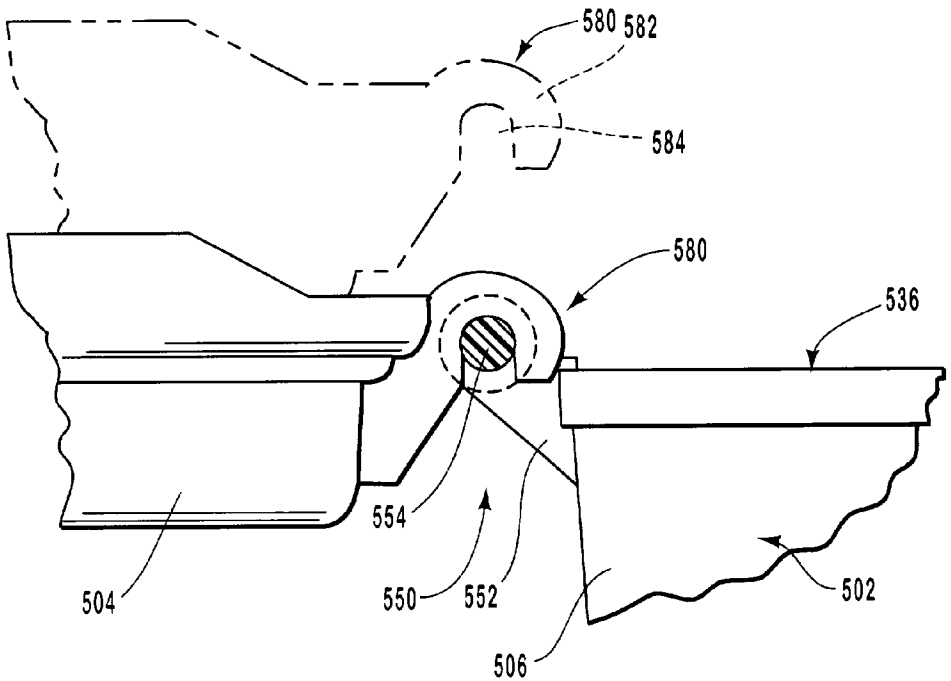
FIG. 21B is an enlarged side view of a portion of the container shown in FIG. 19, illustrating a portion of the pivotal connection of the lid to the body of the container when the lid is in an open position and, as shown in phantom, when the lid is removed from the container.
Figure 21C:
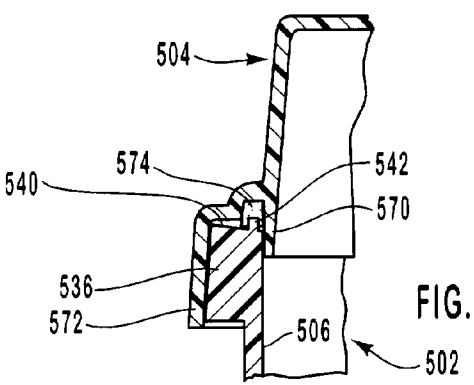
FIG. 21C is an enlarged partial cross sectional view of the container shown in FIG. 19 in the closed position.
Figure 21A:
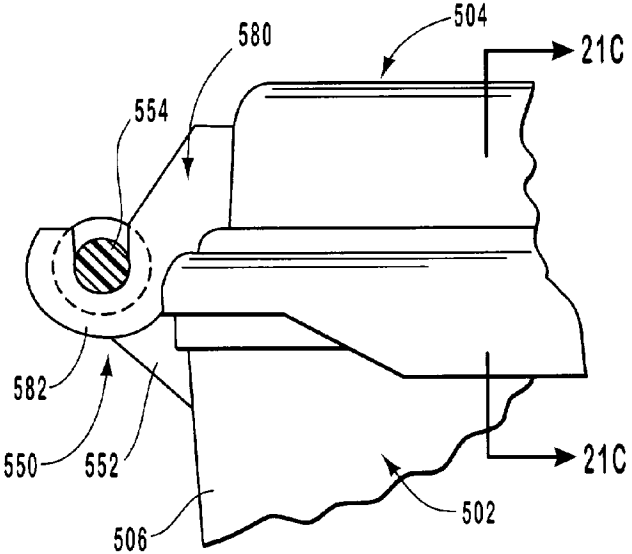
FIG. 21A is an enlarged side view of a portion of the container shown in FIG. 19, illustrating one embodiment of a portion of a pivotal connection of the lid to the body of the container when the lid is in a closed position.

As illustrated in FIGS. 20, 21A and 21B, in one embodiment, container 500 includes hinge portions 550. Hinge portions 550 are configured to selectively, releasably and rotatably connect lid 504 to body 502 of container 500. More specifically, in one possible embodiment, hinge portion 550 comprises pairs of spaced-apart support arms 552, a generally circular connecting member 554 extending there between, and hook-like members 580. More specifically, in one embodiment three (3) pairs of support arms 552 extend outwardly from wall 506. A connecting member 554 extends between each pair of support arms 552. It will be appreciated by one skilled in the art that various other numbers of pairs of support arms 552, connecting members 554, and hook-like members 580 could be used and perform the function of selectively, releasably and rotatably connecting lid 504 to body 502.

In one possible embodiment depicted in FIG. 20, support arms 552 and connecting member 554 extend outwardly from wall 506 on the left side of body 502 of container 500. It will be appreciated that while in one illustrated embodiment, hinge-forming portions 550 are disposed on the left, they could alternatively be on any of the other walls 506 of body 502 and carry out the intended function thereof.

In one embodiment, hinge portions 550 are integrally formed with body 502 of the container 500. One skilled in the art will appreciate that hinge portions 550 may be attached to the body 502 using any suitable fastening or connecting method, including but not limited to, gluing, welding, and the like. Additionally, one skilled in the art will appreciate that container 500 may include any suitable number of hinge portion 550 depending, for example, upon the size of body 502 or lid 504. Further, support arms 552 may be separated by any suitable distance and correspondingly, connecting member 554 may have any suitable corresponding length. It will be appreciated that in one embodiment, illustrated in FIG. 20, the distance between the pairs of support arms 552 and corresponding length of connecting member 554 varied. Alternatively, the pairs of support arms 552 and corresponding length of connecting member 554 could all be the same.

Hook-like members 580 are attached to lid 504 so as to cooperate with support arms 552 and connecting member 554. In one embodiment, hook-like members 580 are integrally formed with lid 504. One skilled in the art will appreciate that hook-like members 580 may be attached to lid 504 using any suitable fastening or connecting method, including but not limited to, gluing, welding, and the like. In addition, it will be appreciated by one skilled in the art that the positions of hook-like members 580 and support arms 552 with connecting member 554 could be reversed. In other words, hook-like members 580 could be formed on body 502 and support arms 552 with connecting member 554 could be formed on lid 504 and carry out the intended function thereof.

Turning to FIGS. 21A and 21B, one embodiment of hook-like members 580 are shown in further detail. Hook-like members 580 extend outwardly from lid 504 and comprise curved portion 582 with opening 584 formed therein. It will be appreciated that hook-like members 580 are positioned on lid 504 to cooperate with support arms 552 and connecting members 554. Curved portions 582 and openings 584 are sized and configured to receive connecting members 554 therein to allow lid 504 to be selectively, releasably and rotatably connected to body 502 of container 500. In particular, curved portions 582 allow connecting members 554 to be disposed in opening 584, thereby allowing lid 504 to be selectively rotated between the open position shown in FIG. 20, and the closed position shown in FIG. 19. Advantageously, lid 504 is also selectively removably attached to body 502. In order to remove lid 504 from body 502, lid 504 is simply rotated such that the connecting members 554 can be removed from opening 584 of curved portion 582 to allow lid 504 to be freely removed from body 502.

Hinge portion 550 comprising pairs of spaced-apart support arms 552, a generally circular connecting member 554 extending there between, and hook-like members 80 is one example of structure capable of performing the function of means for selectively attaching lid 504 to body 502. It will be appreciated that various other types and configurations of structure are available that can perform the function of selectively attaching lid 504 to body 502. Various other types of structure that may be used as such a means for selectively attaching lid 504 to body 502 including, by way of example and not limitation, forming a snap fit or slip fit there between, sliding engagement there between, a hinge like member, nut and bolt, a cooperating opening and pin, and other mechanical coupling methods.

In one embodiment, lid 504 and body 502 when in the closed position illustrated in FIG. 19, optionally seal enclosed, interior space 510 of body 502. It will be appreciated that various methods and structures may be used to seal lid 504 and body 502. As depicted in FIG. 20, in one embodiment, the underside of lid 504 includes an edge 568 along the perimeter thereof that includes an inner flange 570 and outer flange 572. A seal 574 is disposed between inner and outer flanges 570 and 572, respectively. In one embodiment, seal 574 is constructed from a resilient, flexible material such as rubber, and is sized and configured to engage the upper surface 540 of lip 536 on body 502 to create a secure seal between lid 504 and body 502, when lid 504 is in a closed position as seen in FIG. 19. It will be appreciated that various other types of structures and materials could be used to form seal 574. By way of example and not limitation, seal 574 could be formed of various polymers and other materials capable of forming a seal. In addition, it will be appreciated that a seal may be formed between lid 504 and body 502 without the use of seal 574 depending on the materials comprising lid 504 and body 502 or the particular configuration thereof.

In one embodiment, when lid 504 is in the closed position as shown in FIG. 19, inner flange 70 is designed to be disposed along or in contact with the remote end of inner surfaces of walls 506 of body 502, and outer flange 572 is designed to be disposed along or contact the outer edge of lip 536. When lid 504 is in a closed position, seal 574 engages upper surface 540 and upwardly extending section 542 of lip 536. In addition, seal 574 is at least partially deformed to create a tight seal between lid 504 and body 502. Thus, inner flange 570, outer flange 572 and seal 574 cooperate with upper surface 540 and upwardly extending section 542 of lip 536 on body 502 to form a tight seal between lid 504 and body 502 when container is in the closed position.

In one embodiment, a generally water-tight or water-resistant seal is created that prevents water from entering or exiting container 500 when lid 504 is closed. Additionally, this seal may be generally air tight to prevent air and other gasses from entering or exiting container 500 when lid 504 is closed. It will be appreciated, however, that in another embodiment, lid 504 and body 502 may not be either air and/or water tight, but container 500 is capable of performing its intended function.

The present invention also comprises a closing mechanism or clasp 560 for retaining lid 504 in a closed position. It will be appreciated that various methods and structures for retaining lid 504 in closed position are available and are well known in the art, and any such structures or methods may be used in conjunction with the present invention without departing from its spirit and scope. As depicted in FIGS. 19 and 20, clasp 560 is pivotally attached to wall 506. In one embodiment illustrated in FIGS. 19 and 20, clasp 560 is depicted as being attached to the right side of container 500. It will be appreciated that clasp 560 could be mounted on any of the walls and perform the function thereof. Alternatively, in another embodiment, clasp 560 could be mounted on lid 504 and still perform the function thereof.

In one embodiment, shown in FIG. 20, clasp 560 includes a base 562 which is pivotally attached to body 502 and an arm 564 which is pivotally attached to base 562. Arm 564 includes a lip 566 which, as described below, is configured to grasp outwardly extending teeth 92 (FIG. 22) formed on lid 504. Clasp 560 allows container 500 to be securely closed. Clasp 560 also allows container 500 to be quickly and easily opened by simply lifting base 562, which causes lip 566 to disengage from teeth 592 formed in lid 504, and moves arm 564 away from lid 504.

Figure 22:
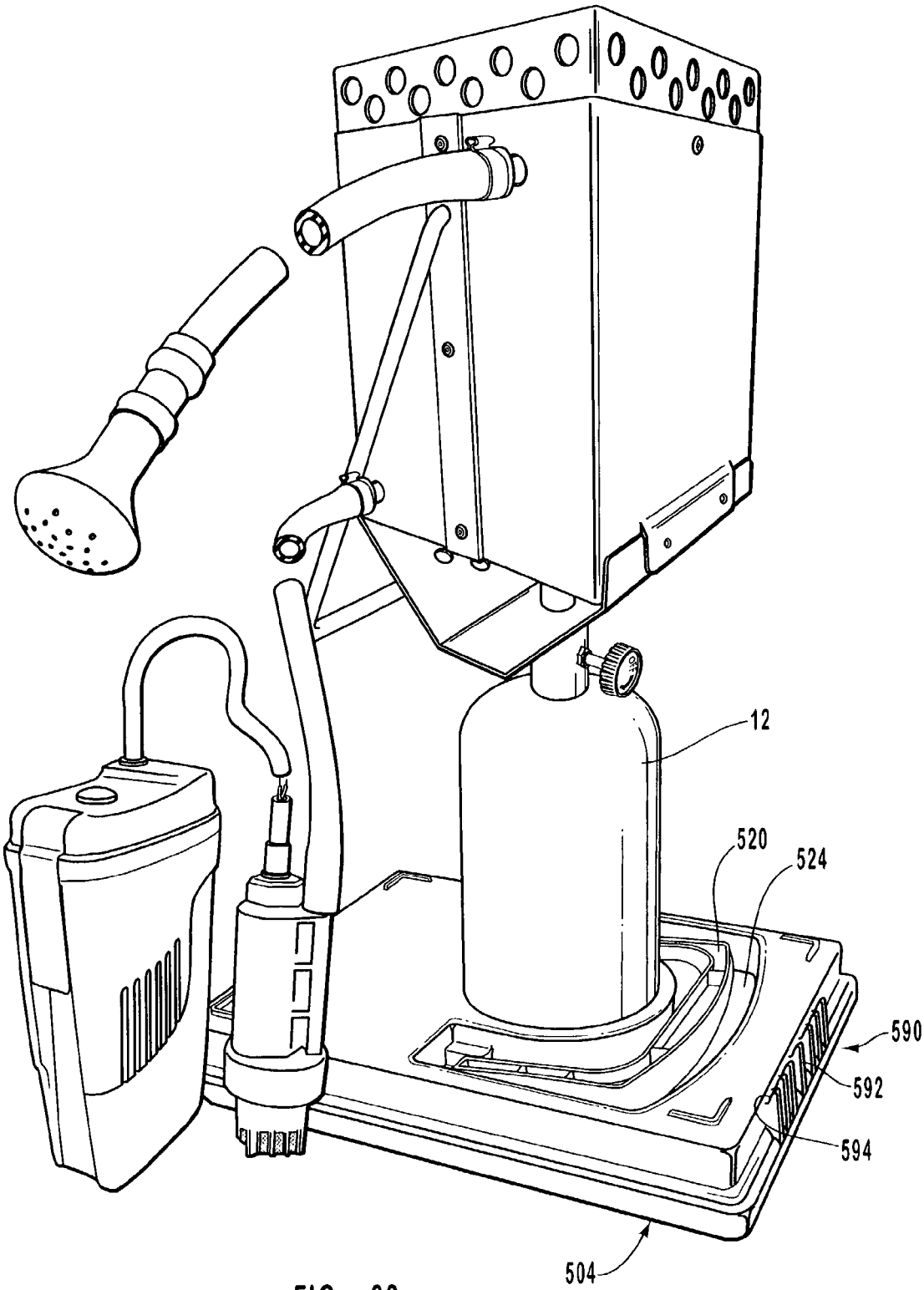
FIG. 22 is a perspective view of another embodiment of a lid that may be used in conjunction with the container shown in FIG. 19.

More specifically, as depicted in FIG. 22, in one embodiment, lid 504 includes a plurality of teeth 590 formed on lid 504 to cooperate with arm 564 of clasp 560. Teeth 592 are sized and configured to engage lip 566 on arm 564 of clasp 560. In one embodiment, teeth 590 include an upwardly extending portion 592 and a receiving notch 594. In order to close lid 504 of container 500, lip 566 of clasp 560 is positioned in receiving notch 594 and, when base 562 of clasp 560 is moved downwardly, lip 566 engages teeth 590 and pulls lid 504 downwardly to securely hold the lid 504 in the closed position depicted in FIG. 19.

In one embodiment, lid 504 has a generally rectangular configuration with dimensions that generally correspond to the length and width of body 502 of container 500. It will be appreciated that lid 504 may have various other configurations as long as it cooperates with body 502 of container 500. In one embodiment, lid 504 has a length of about 12 inches and a width of about 9 inches, but the size of the lid may vary according to the size of body 502 of container 500. Additionally, in one embodiment, the height of lid 504 is about 1 to 2 inches. It will be appreciated that the height of lid 504 may be larger or smaller depending, for example, upon the intended use of the container 500.

As shown in FIG. 19, lid 504 includes an upper surface 518 having a recess 524 formed. As depicted, a recessed handle 520 is disposed in recess 524. It will be appreciated that recess 524 and recessed handle 520 may have various configurations and perform the function thereof. The important aspect is that recess 524 and recessed handle 520 be configured to cooperate such that when recessed handle 520 is in recess 524 recessed handle 520 is completely disposed below surface 518 of lid 504. Recessed handle 520 is pivotally attached to lid 504 to facilitate carrying and transport of the container 500.

As shown in FIG. 19, recess 524 and recessed handle 520 are configured so that recessed handle 520 is disposed in recessed 104 formed in upper surface 518 of lid 504 when recessed handle 520 is not in use. In one embodiment, recessed handle 520 includes first ends 524 disposed into corresponding apertures or holes (not shown) in lid 504, to pivotally attach recessed handle 520 to lid 504. It will be appreciated that various methods of rotatably attaching recessed handle 520 in recess 524 of lid 504 may be utilized. Recessed handle 520 is securely attached to lid 504 to allow container 500 to be carried when it is filled with equipment or fluids such as water. The design of recessed handle 520 allows containers 10 to be easily stacked. Further, by having recessed handle 520 capable of being disposed in recess 524 formed in lid 504 prevents items from being inadvertently snagged by lid 504.

As illustrated in FIG. 19, a recessed receiving area 528 is also formed in lid 504. Receiving area 528 is sized and configured to receive at least one fuel source (not shown) for portable heating equipment. In one embodiment, receiving area 528 has a generally circular configuration with a diameter of about 4 inches and a depth of about 1 inch. One skilled in the art will appreciate that receiving area 528 may have other suitable dimensions and configurations depending, for example, upon the size of the fuel source to be received within receiving area 528 and the height of lid 504.

In one embodiment depicted in FIG. 19, receiving area 528 is configured so as to receive two fuel sources. It will be appreciated that receiving area 528 may have various configurations. By way of example, in an alternate embodiment depicted in FIG. 22, receiving area is configured to receive only one fuel source. As shown in the accompanying figures, lid 504 may include two receiving areas 528 to receive two fuel sources. Advantageously, this allows lid 504 to be used with either a single fuel source or double fuel source. It will be understood that lid 504 can include any suitable number of receiving areas 528 and they can be arranged in any desirable pattern or arrangement.

As seen in FIG. 19, receiving area 528 is preferably sized and configured to support a fuel source 12 such as a pressurized cylinder filled with a flammable gas such as propane. Receiving area 528 supports fuel source 12 in a generally upright position so as to assist in preventing fuel source 12 from falling or tipping over. In one embodiment, lid 504 may be detached from body 502 of container 500 and placed on a generally flat surface such as the ground. As such, lid 504 supports fuel source 12 in a generally upright position and prevents it from falling over. Container 500 may be filled with a heavy substance (e.g., water) to prevent container 500 from tipping over.

Returning to FIG. 19, in one embodiment, receiving area 528 includes a plurality of engagement ribs 530 formed along the periphery thereof. Engagement ribs 530 are sized and configured to securely retain the fuel source within receiving area 528. It will be appreciated that engagement ribs 530 may have various other configurations. As shown in the accompanying figures, lid 504 may include a receiving area 528 designed to accommodate two fuel sources therein. Advantageously, this allows lid 504 to be used with either a single fuel source or double fuel source. It will be understood that lid 504 can include any suitable number of receiving areas 528 arranged in any desirable pattern or arrangement.

Figure 5:
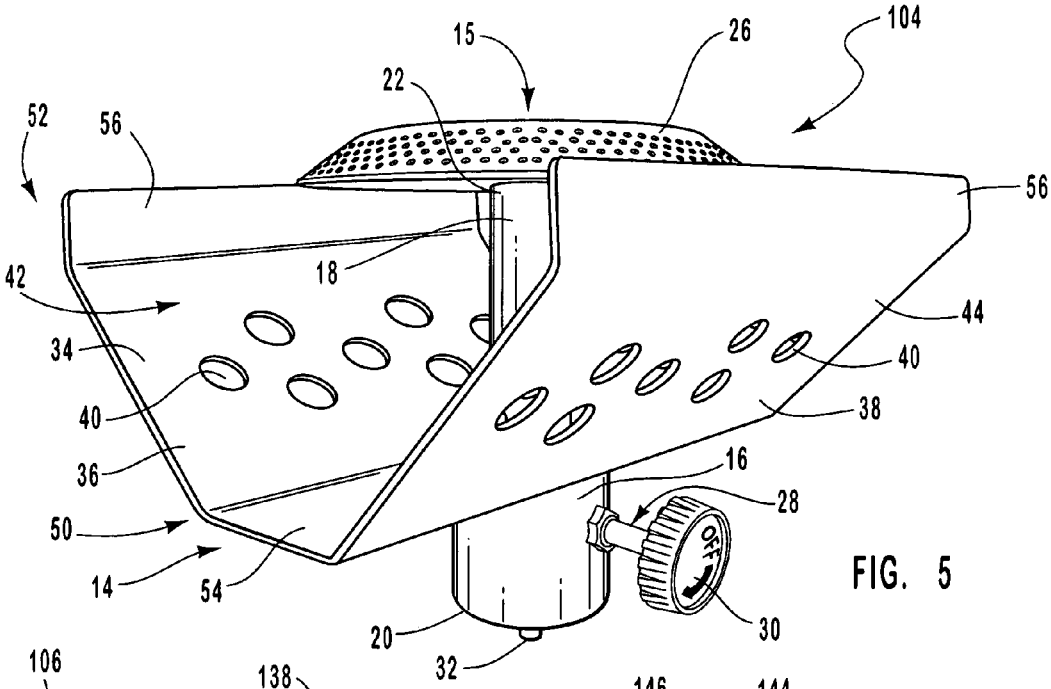
FIG. 5 is a perspective view of one embodiment of the fuel burner assembly of FIG. 1.

As seen in FIG. 22, receiving area 528 is preferably sized and configured to support a fuel source 12, such as a pressurized cylinder filled with a flammable gas such as propane. Receiving area 528 supports fuel source 12 in a generally upright position and helps prevent fuel source 12 as well as the portable heating equipment being used with fuel source 12 from falling or being tipped over. FIG. 10 shows portable fuel source 122 and heating equipment being disposed in receiving area 528 of lid 504 on container 500. Alternatively, as illustrated in FIG. 5, lid 504 can be removed from body 502 and then fuel source 122 and portable heating equipment is supported by lid 504. More specifically, when lid 504 is placed on a generally flat surface such as the ground, lid 504 supports fuel source 12 in a generally upright position and prevents it from falling or tipping over.

Returning to FIG. 19, in one embodiment, lid 14 includes optional retaining members 124 that are sized and configured to engage optional feet 30 of another container 10 when the containers are in a stacked position. Retaining members 124 assists in stacking the containers 10 by helping to retain the containers in vertical alignment. Advantageously, stacked containers 10 help to minimize storage space required for a plurality of containers. In one embodiment, retaining members 124 include two upwardly extending portions 126 that are joined to generally form a right angle, thereby forming receiving portions 128 for feet 30 of a stacked container.

When in a stacked position, feet 30 of a stacked container 10 contact surface 100 of lid 14 just outside of upwardly extending portion 126 of retaining members 124. Retaining members 124 thereby prevent feet 30 of stacked container 10 from sliding off of surface 100 of lid 14 of the lower container 10. It will be appreciated that alternatively, feet could fit inside upwardly extending portion 12 of retaining members 124. Further, various other configurations of feet 30 and retaining members could be used and still perform the function thereof. For example, an upwardly extending notch could be formed on surface 100 of lid 14 which could be received in a recess formed in foot 30. In one embodiment, lid 504 and body 502 of container 500 are constructed from a durable, lightweight material such as plastic. Plastic is used because it can be readily molded or formed into the desired shape, and it is relatively easy and inexpensive to manufacture. Plastic is preferably impact resistant to form a durable and rugged container that helps protect the heating system during storage and transportation. It will be appreciated that container 500 may be made of various other materials without effecting the function thereof. By way of example and not limitation container 500 could be formed of various polymers, composites, carbon fiber materials, metals, metal alloys and mixtures thereof as well as other materials capable of being formed into container 500.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A multi-purpose heating unit comprising:

a fuel burner assembly configured to produce heat as fuel is burned, said fuel burner assembly comprising a burner to burn the fuel and a heat shield sized and configured to facilitate heat transfer from said burner; and a plurality of attachments selectively attachable to said fuel burner assembly, each of the plurality of attachments being configured to provide a separate function, at least one of said plurality of attachments comprises a heating member, wherein said fuel burner assembly is common to each of said plurality of attachments.

2. The multi-purpose heating unit as recited in claim 1, wherein one of said attachments comprises a water heater attachment including said heating member, said heating member comprising a heat transfer conduit configured to transfer the heat produced by said fuel burner assembly to water flowing through said heat transfer conduit.

3. The multi-purpose heating unit of claim 2, wherein said heat transfer conduit comprises at least one coiled tube.

4. The multi-purpose heating unit of claim 3, wherein at least a portion of said coiled tubing forms a cylindrical shaped member.

5. The multi-purpose heating unit as recited in claim 1, wherein the fuel burner assembly comprises a heating element having said shield disposed thereon.

6. The multi-purpose heating unit as recited in claim 5, wherein said heating element further comprises a fuel conduit.

7. The multi-purpose heating unit as recited in claim 4, wherein the conduit comprises a coiled tube.

8. The multi-purpose heating unit as recited in claim 2, further comprising:

a pump; and an inlet conduit having a first end selectively coupled to the inlet and a second end selectively coupled to the pump, the pump being adapted to direct liquid through the inlet conduit to said heat transfer conduit.

9. The multi-purpose heating unit as recited in claim 8, further comprising an outlet conduit having a first end selectively coupled to the outlet and a second end terminating in a spray nozzle.

10. The multi-purpose heating unit as recited in claim 1, wherein at least one of the plurality of attachments comprises a cooking attachment configured to be selectively attachable to the fuel burner assembly.

11. The multi-purpose heating unit as recited in claim 1, wherein at least one of the plurality of attachments comprises a light source attachment selectively couplable to the fuel burner assembly.

12. The multi-purpose heating unit as recited in claim 1, further comprising a container for transporting the plurality of attachments, the container having a selectively detachable lid.

13. A multi-purpose heating unit comprising:

a fuel burner assembly configured to produce heat as fuel is burned, said fuel burner assembly comprising a burner to burn the fuel and a heat shield sized and configured to facilitate heat transfer from said burner; and a first attachment configured to be selectively attached to said fuel burner assembly; and a second attachment configured to be selectively attached to said fuel burner assembly, wherein said fuel burner assembly is common to each of said first attachment and said second attachment.

14. The multi-purpose heating unit of claim 13, wherein:

said first attachment comprises a water heating attachment; and said second attachment comprises an air heating attachment.

15. The multi-purpose heating unit as recited in claim 14, wherein said fuel burner assembly comprises a heating element having said shield disposed thereon, and said first attachment comprises a heating assembly.

16. The multi-purpose heating unit as recited in claim 13, wherein said heating assembly comprises a housing configured to selectively engage said fuel burner assembly.

17. The multi-purpose heating unit as recited in claim 16, wherein said heating assembly comprises a conduit disposed in said housing.

18. The multi-purpose heating unit as recited in claim 17, wherein the conduit comprises a coiled tube.

19. The multi-purpose heating unit as recited in claim 13, wherein said first attachment comprises an air heating attachment configured to selectively attach to said burner assembly, said air heating attachment comprising:

an air transfer assembly capable of drawing air from a location remote from the exhaust gases produced by said fuel burner and releasing the air at a desired location; and at least one heat transfer member fluidly connected to said air transfer assembly, each of said at least one heat transfer member being configured to transfer the heat produced by said fuel burner assembly to air flowing through said at least one heat transfer member, each of said at least one heat transfer member isolating the air being heated from the exhaust gases produced by said fuel burner.

20. The multi-purpose heating unit as recited in claim 13, wherein said second attachment comprises a water heating attachment configured to selectively attach to said burner assembly, said water heating attachment comprising:

a heat transfer conduit fluidly connected to a water source, said heat transfer conduit being configured to transfer the heat produced by said fuel burner assembly to the water flowing through said heat transfer conduit; and a pump being sized and configured to pump water through said heat transfer conduit with sufficient force to allow a user to take a shower.

21. The multi-purpose heating assembly as recited in claim 13, further comprising an air heating attachment selectively exchangeable with said water heating attachment, said air heating attachment comprising a heating assembly selectively couplable to the fuel burner assembly.

22. The multi-purpose heating assembly as recited in claim 13, wherein said heating assembly further comprising a heating core.

23. The multi-purpose heating unit as recited in claim 22, wherein the heating core comprises a plurality of conduits extending between the air inlet and the air outlet.

24. The multi-purpose heating unit as recited in claim 13, further comprising a cooking attachment selectively exchangeable with the water heating attachment, wherein the cooking attachment is selectively couplable to the fuel burner assembly.

25. The multi-purpose heating unit as recited in claim 13, further comprising a light source attachment selectively exchangeable with the water heating attachment, wherein the light source attachment is selectively couplable to the fuel burner assembly.

26. The multi-purpose heating unit as recited in claim 13, further comprising a container for transporting the fuel burner assembly and the water heating attachment, said container comprising a selectively detachable lid.

27. A multi-purpose heating assembly comprising:

a fuel burner assembly capable of being connected to a fuel source and selectively attachable to a plurality of attachments, said fuel burner assembly comprising a burner to burn a fuel from said fuel source and a heat shield sized and configured to facilitate heat transfer from said burner, said fuel burner assembly being common to each of said plurality of attachments; and a first attachment of said plurality of attachments for heating water, the first attachment being removably attached to said fuel burner assembly, said first attachment comprising a heating conduit.

28. The multi-purpose heating unit as recited in claim 26, further comprising a second attachment of said plurality of attachments for heating air, the second attachment being selectively exchangeable with the first attachment, the second attachment comprising:

a heating assembly selectively couplable to the fuel burner assembly, the heating assembly further comprising an air inlet, an air outlet, and a heating core disposed there between, the heating core further having an outside surface being at least partially disposed in communication with the fuel burner assembly; and an air transfer assembly selectively coupled to the air inlet and air outlet, the air transfer assembly configured to direct air to and from the heating assembly.

29. The multi-purpose heating unit as recited in claim 27, further comprising a third attachment of said plurality of attachments for cooking, the third attachment being selectively exchangeable with the first attachment and being selectively couplable to the fuel burner assembly.

30. The multi-purpose heating unit as recited in claim 27, further comprising a fourth attachment of said plurality of attachments for providing a light source, the fourth attachment being selectively exchangeable with the first attachment and being selectively couplable to the fuel burner assembly.

31. The multi-purpose heating unit as recited in claim 27, wherein the heating core comprises a plurality of heat transfer tubes.

32. The multi-purpose heating unit as recited in claim 27, wherein the heating assembly comprises a plurality of deflectors positioned around the heating core.

33. The multi-purpose heating unit as recited in claim 27, further comprising a container for transporting the fuel burner assembly and the first attachment, the container comprising a selectively detachable lid.

34. A portable kit for providing multiple heating uses, the kit comprising:

a fuel source;

a fuel burner assembly configured to produce heat as fuel is burned and to selectively attach to a plurality of attachments, said fuel burner assembly being common to each of said plurality of attachments and comprising a burner to burn the fuel and a heat shield sized and configured to facilitate heat transfer from said burner to each of said plurality of attachments; and a first attachment of said plurality of attachments for heating water, said first attachment comprising a heating assembly selectively couplable to the fuel burner assembly, said heating assembly further comprising a heating core disposed there between.

35. The portable kit as recited in claim 34, further comprising a second attachment of said plurality of attachments for heating air and selectively exchangeable with the first attachment, the second attachment comprising a heating assembly selectively couplable to the fuel burner assembly, the heating assembly further comprising a heating core disposed there between.

36. The portable kit as recited in claim 34, further comprising a third attachment of said plurality of attachments for providing a cooking surface and selectively exchangeable with the first and second attachments, the third attachment being selectively couplable to the fuel burner assembly.

37. The portable kit as recited in claim 35, further comprising a fourth attachment of said plurality of attachments for providing a light source and selectively exchangeable with the first, second and third attachments, the fourth attachment being selectively couplable to the fuel burner assembly.

38. The portable kit as recited in claim 36, further comprising a fourth attachment of said plurality of attachments for providing a light source, the fourth attachment being selectively couplable to the fuel source.

39. The portable kit as recited in claim 34, wherein the heating core comprises a conduit extending between the liquid inlet and the liquid outlet.

40. The portable kit as recited in claim 38, wherein the heating core comprises at least one heat transfer tube extending between the air inlet and the air outlet.

41. The portable kit as recited in claim 36, further comprising a container for transporting the fuel source, the fuel burner assembly and the first attachment, the container comprising a detachable lid.

42. A combination, multi-purpose unit comprising:

a fuel burner assembly configured to produce heat as fuel is burned, said fuel burner assembly comprising a burner to burn a fuel and a heat shield sized and configured to facilitate heat transfer from said burner; and a plurality of interchangeable attachments selectively attachable to said fuel burner assembly, each of said plurality of interchangeable attachments performing a separate function, wherein said plurality of interchangeable attachments being selected from the group consisting of a water heating attachment, an air heating attachment, a lantern attachment, and a cooking attachment;

wherein said fuel burner assembly is common to each of said plurality of attachments.

43. The combination, multi-purpose unit as recited in claim 42, wherein said water heating attachment comprises:

a housing selectively attachable to said fuel burner assembly;

a heat transfer conduit disposed in said housing, said heat transfer conduit being fluidly connected to a water source, said heat transfer conduit being configured to transfer the heat produced by said fuel burner assembly to the water flowing through said heat transfer conduit.

44. The combination, multi-purpose unit as recited in claim 43, wherein said heat transfer conduit comprises at least one coiled tube.

45. The combination, multi-purpose unit as recited in claim 43, wherein;

said housing of said water heating attachment has an inlet and an outlet fluidly connected by said heat transfer conduit; and said water heating attachment further comprising:

an inlet conduit having a first end selectively coupled to said inlet of said housing and a second end fluidly connected to the water source; and an outlet conduit having a first end selectively coupled to said outlet of said housing and a second end terminating in a spray nozzle.

46. The combination, multi-purpose unit as recited in claim 43, wherein said air heating attachment comprising:

an air transfer assembly capable of drawing air from a location remote from the exhaust gases produced by said fuel burner assembly and releasing the air at a desired location; and at least one heat transfer member fluidly connected to said air transfer assembly, each of said at least one heat transfer member being configured to transfer the heat produced by said fuel burner assembly to air flowing through said at least one heat transfer member, each of said at least one heat transfer member isolating the air being heated from the exhaust gases produced by said fuel burner assembly.

47. A combination, multi-purpose unit comprising:

a fuel burner assembly configured to produce heat as fuel is burned; and an air heating attachment configured to selectively attach to said burner assembly, said air heating attachment comprising:

an air transfer assembly capable of drawing air from a location remote from the exhaust gases produced by said fuel burner and releasing the air at a desired location; and at least one heat transfer member fluidly connected to said air transfer assembly, each of said at least one heat transfer member being configured to transfer the heat produced by said fuel burner assembly to air flowing through said at least one heat transfer member, each of said at least one heat transfer member isolating the air being heated from the exhaust gases produced by said fuel burner; and a water heating attachment configured to be selectively attached to said fuel burner assembly, said water heating attachment being selectively interchangeable with said air heating attachment, said water heating attachment comprising:

a housing selectively attachable to said fuel burner assembly;

a heat transfer conduit disposed in said housing, said heat transfer conduit being fluidly connected to a water source, said heat transfer conduit being configured to transfer the heat produced by said fuel burner assembly to the water flowing through said heat transfer conduit; and a pump being sized and configured to pump water through said heat transfer conduit.

48. The combination, multi-purpose unit as recited in claim 47, further comprising a cooking support attachment selectively interchangeable with said air heating attachment and said water heating attachment, said cooking support attachment being selectively attachable to the fuel burner assembly.

49. The combination, multi-purpose unit as recited in claim 47, further comprising a light source selectively interchangeable with said air heating attachment and said water heating attachment, said light source being selectively attachable to the fuel burner assembly.

50. A multi-purpose heating assembly comprising:

a fuel burner assembly capable of being connected to a fuel source;

a first attachment for heating water, the first attachment being removably attached to said fuel burner assembly, said first attachment comprising a heating conduit; and a second attachment for heating air, the second attachment being selectively exchangeable with the first attachment, the second attachment comprising:

a heating assembly selectively couplable to the fuel burner assembly, the heating assembly further comprising an air inlet, an air outlet, and a heating core disposed there between, the heating core further having an outside surface being at least partially disposed in communication with the fuel burner assembly; and an air transfer assembly selectively coupled to the air inlet and air outlet, the air transfer assembly configured to direct air to and from the heating assembly.

51. The multi-purpose heating unit as recited in claim 50, further comprising a third attachment for cooking, the third attachment being selectively exchangeable with the first attachment and being selectively couplable to the fuel burner assembly.

52. The multi-purpose heating unit as recited in claim 50, further comprising a fourth attachment for providing a light source, the fourth attachment being selectively exchangeable with the first attachment and being selectively couplable to the fuel burner assembly.

* * * * *

UNITED STATES PATENT AND TRADEMARK OFFICE

CERTIFICATE OF CORRECTION

PATENT NO. : 6,929,190 B1
APPLICATION NO. : 10/222667
DATED : August 16, 2005
INVENTOR(S) : Trevor Adrian It is certified that error appears in the above-identified patent and that said Letters Patent is hereby corrected as shown below:

Column 8
Line 19, after "unit", remove "in"

Column 13
Line 24, change "1110" to --110--

Column 16
Line 15, change "438" to --138--

Column 18
Line 67, change "allowing" to --allow--

Column 23
Line 48, before "operation", insert --in--

Column 30
Line 24, after "with", insert
--respect to other attachments that may be used with multi-purpose heating unit 8. It--

Column 31
Line 50, after "544", change "is" to --are--

Column 32
Line 4, change "14" to --504--
Line 5, change "14" to --504--
Line 5, change "12" to --502--
Line 6, change "12" to --502--
Line 7, change "14" to --504--
Line 8, change "60" to --650--
Line 9, change "14" to --504--

Column 32
Line 10, change "12" to --502--
Line 12, change "14" to --504--
Line 12, change "12" to --504--
Line 13, change "14" to --504--

Column 33
Line 26, change "80" to --580--
Line 61, change "70" to --570--

UNITED STATES PATENT AND TRADEMARK OFFICE

CERTIFICATE OF CORRECTION

PATENT NO. : 6,929,190 B1
APPLICATION NO. : 10/222667
DATED : August 16, 2005
INVENTOR(S) : Trevor Adrian It is certified that error appears in the above-identified patent and that said Letters Patent is hereby corrected as shown below:

Column 34
Line 34, change “92” to --590--
Line 42, change “592” to --590--

Column 35
Line 9, change “recessed 104” to --recess 524--
Line 19, change “10” to --500--

Column 36
Line 12, change “122” to --12--
Line 14, change “FIG. 5” to --FIG. 4--
Line 15, change “122” to --12--
Line 21, change “14” to --504--
Line 22, change “124” to --534--
Line 23, change “30” to --512--
Line 23, change “10” to --500--
Line 25, change “124” to --534--
Line 25, change “assists” to --assist--
Line 25, change “10” to --500--
Line 27, change “10” to --500--

UNITED STATES PATENT AND TRADEMARK OFFICE

CERTIFICATE OF CORRECTION

PATENT NO. : 6,929,190 B1
APPLICATION NO. : 10/222667
DATED : August 16, 2005
INVENTOR(S) : Trevor Adrian It is certified that error appears in the above-identified patent and that said Letters Patent is hereby corrected as shown below:

Column 36
Line 29, change "124" to --534--
Line 30, change "126" to --537--
Line 31, remove "128"
Line 31, change "30" to --512--
Line 34, change "30" to --512--
Line 35, change "10" to --500--
Line 35, change "100" to --518--
Line 35, change "14" to --504--
Line 36, change "126" to --537--
Line 36, change "124" to --534--
Line 37, change "124" to --534--
Line 37, change "30" to --512--
Line 38, change "10" to --500--
Line 38, change "100" to --518--
Line 38, change "14" to --504--
Line 39, change "10" to --500--
Line 40, change "12" to --537--
Line 41, change "124" to --534--
Line 42, change "30" to --512--
Line 44, change "100" to --518--
Line 44, change "14" to --504--
Line 45, change "30" to --512--

Signed and Sealed this

Seventh Day of August, 2007

JON W. DUDAS
*Director of the United States Patent and Trademark Office*